US010394159B2

(12) United States Patent
Takezawa et al.

(10) Patent No.: US 10,394,159 B2
(45) Date of Patent: Aug. 27, 2019

(54) IMAGE FORMING APPARATUS

(71) Applicant: CANON KABUSHIKI KAISHA, Tokyo (JP)

(72) Inventors: Satoru Takezawa, Abiko (JP); Takahiro Kamikura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 147 days.

(21) Appl. No.: 15/710,047

(22) Filed: Sep. 20, 2017

(65) Prior Publication Data

US 2018/0088484 A1 Mar. 29, 2018

(30) Foreign Application Priority Data

Sep. 23, 2016 (JP) ..... 2016-185367

(51) Int. Cl.
*G03G 15/04* (2006.01)
*G03G 15/043* (2006.01)

(52) U.S. Cl.
CPC ..... *G03G 15/043* (2013.01); *G03G 15/04036* (2013.01)

(58) Field of Classification Search
CPC ..... G03G 15/043; G03G 15/04036; G03G 15/04072
See application file for complete search history.

(56) References Cited

U.S. PATENT DOCUMENTS

2012/0188328 A1* 7/2012 Takezawa ..... G06K 15/1209 347/247
2013/0293661 A1* 11/2013 Takezawa ..... B41J 2/471 347/224

FOREIGN PATENT DOCUMENTS

JP 2015-041015 A 3/2015

* cited by examiner

*Primary Examiner* — Hoang X Ngo
(74) *Attorney, Agent, or Firm* — Canon U.S.A., Inc. IP Division

(57) ABSTRACT

A CPU controls an image forming unit such that toner images for density detection are formed in parallel in a scanning direction of light beam under an image forming condition in which a period of time in which the light beam are emitted per unit time is changed and sets a target light amount of the light beam based on density information of the toner images for density detection formed by the image forming unit and relational data stored in a ROM.

11 Claims, 19 Drawing Sheets

| | | | | | | | |
|---|---|---|---|---|---|---|---|
| TONER PATTERNS FOR DENSITY DETECTION | 50% | 60% | 70% | 80% | 90% | 100% | Y |
| | 50% | 60% | 70% | 80% | 90% | 100% | M |
| | 50% | 60% | 70% | 80% | 90% | 100% | C |
| | 50% | 60% | 70% | 80% | 90% | 100% | K |

| | | | | | | | | | |
|---|---|---|---|---|---|---|---|---|---|
| TONER PATTERNS FOR DENSITY DETECTION | 44% | 49% | 56% | 63% | 68% | 75% | 81% | 84% | Y |
| | 44% | 49% | 56% | 63% | 68% | 75% | 81% | 84% | M |
| | 44% | 49% | 56% | 63% | 68% | 75% | 81% | 84% | C |
| | 44% | 49% | 56% | 63% | 68% | 75% | 81% | 84% | K |

| | | | | | | | | |
|---|---|---|---|---|---|---|---|---|
| IMAGE DATA (GRADATION) | 8 | 9 | 10 | 11 | 12 | 13 | 14 | 15 |

IMAGE FORMING APPARATUS

BACKGROUND OF THE INVENTION

Field of the Invention

The present disclosure relates to an image forming apparatus including an optical scanning apparatus which forms an image on a photoconductor by performing scanning using laser beams incident on the photoconductor.

Description of the Related Art

Image forming apparatuses employing an electrophotographic method, such as copiers and laser beam printers, form an electrostatic latent image by performing scanning using a laser beam emitted from a semiconductor laser device on a photoconductor. The formed electrostatic latent image is developed using toner so that a toner image is formed on the photoconductor. The toner image formed on the photoconductor is transferred to a transfer belt and further transferred on a sheet from the transfer belt. Thereafter, temperature is increased and pressure is applied on the sheet by a fixing device so that the unfixed toner image is fixed on the sheet. Japanese Patent Laid-Open No. 2015-041015 discloses an image forming apparatus which controls an amount of laser light so that density of toner reaches target density at a time of printing.

Different amounts of laser light are required for the target density depending on ambient temperature and sensitivity of a photoconductor. Therefore, an amount of light emitted from a light source is required to be controlled so that density of an output image reaches the target density. To control a light amount, in general, laser light is emitted to a photoconductor while an amount of the laser light is changed from a maximum value of 100% to 50%, for example, in a step-by-step manner so that toner patterns for density detection corresponding to individual light amounts are formed. When a light amount is large, a toner image having high density is formed whereas when a light amount is small, a toner image having low density is formed. The image forming apparatus reads the toner patterns for density detection which have been transferred and fixed on the sheet using an image reading device or an optical sensor disposed on a conveyance path of the sheet so as to detect density. The image forming apparatus compares a result of the detection of the toner patters for density detection corresponding to light amounts read by the image reading device or the optical sensor with target density so as to set a target light amount of the laser light so that an output image is formed in the target density.

In recent years, generation of an excellent image is required even under various environmental conditions including various temperature conditions and various humidity conditions or even when the photoconductor is used a long period of time. Therefore, to form an output image in the target density, the image forming apparatus performs not only control of an amount of laser light described above but also control of various parameters including a developing parameter and a voltage parameter, such as a charging parameter. Accordingly, the image forming apparatus forms toner patterns for density detection by different combinations of the parameters including parameters of a laser light amount, a developing voltage, and a charging voltage. Therefore, in initial control performed after the image forming apparatus is turned on or a control operation performed when the image forming apparatus returns from a waiting state, the image forming apparatus forms a large number of toner patterns for density detection. If a number of the toner patterns for density detection are arranged in a main scanning direction, the number of sheets on which the toner patterns for density detection are formed may be reduced.

However, in the case where a plurality of toner patterns for density detection are arranged in the main scanning direction, the following problems arise. In a graph of FIG. 15, an axis of abscissae denotes a sheet position (in the main scanning direction) and an axis of ordinates denote an amount of laser light. When the toner patters for density detection are formed, an amount of laser light is ideally controlled as illustrated in a solid line of FIG. 15 so that boundaries among the patterns are accurately detected by a sensor. However, an optical scanning apparatus including a laser driving circuit which does not have a shading function may not control an amount of laser light (light intensity) within one scanning period. Therefore, the optical scanning apparatus including the laser driving circuit which does not have the shading function may not form toner patterns for density detection which have different density levels in the main scanning direction by changing an amount of laser light. On the other hand, the optical scanning apparatus including a laser driving circuit having the shading function may control an amount of laser light within one scanning period. However, the laser driving circuit having the shading function has a low-pass filter, and the amount of laser light is smoothly corrected as denoted by a dotted line in FIG. 15 by a function of the low-pass filter. Accordingly, boundary lines of the toner patterns for density detection are not clear, and therefore, it may be difficult for a sensor to detect the toner patterns.

The present invention provides accurate formation of patterns for density detection in a main scanning direction and accurate control of an amount of laser light.

SUMMARY OF THE INVENTION

According to an embodiment of the present invention, an image forming apparatus comprises an image forming unit including a photoconductor, a light source configured to emit light beam in a light amount corresponding to a value of supplied current, a driving unit configured to supply current to the light source in accordance with a first pulse-with-modulation (PWM) signal generated based on image data, which includes a smoothing circuit which outputs a signal obtained by smoothing a second PWM signal input to control a value of the current supplied to the light source, and configured to control the value of the current in accordance with an output of the smoothing circuit, and a deflection unit configured to deflect the light beam emitted from the light source such that the light beam scan the photoconductor, and wherein the image forming unit develops, using toner, electrostatic latent image formed on the photoconductor by being scanned by the light beam, transfers developed toner image on a recording sheet, and fixes the transferred toner image on the recording sheet, and a control unit configured to control the driving unit by changing a pulse width of the first PWM signal so that toner images for density detection having different density levels are formed in parallel in a scanning direction of the light beam, configured to set a target light amount of the light beam based on density information of the toner images for density detection, and configured to control a pulse width of the second PWM signal to be input to the smoothing circuit such that an amount of the light beam emitted from the light source based on the target light amount is controlled in accordance with a scanning position.

Further features of the present invention will become apparent from the following description of exemplary embodiments with reference to the attached drawings.

DESCRIPTION OF THE EMBODIMENTS

Hereinafter, preferred embodiments of the present disclosure will be described in detail with reference to the accompanying drawings. Note that a direction of scanning using laser light and a direction of a rotation axis of a photoconductive drum are referred to as a main scanning direction or a first direction, and a direction which is substantially orthogonal to the main scanning direction and a direction of rotation of the photoconductive drum are referred to as a sub-scanning direction or a second direction.

Entire Configuration of Image Forming Apparatus

Figure 1:
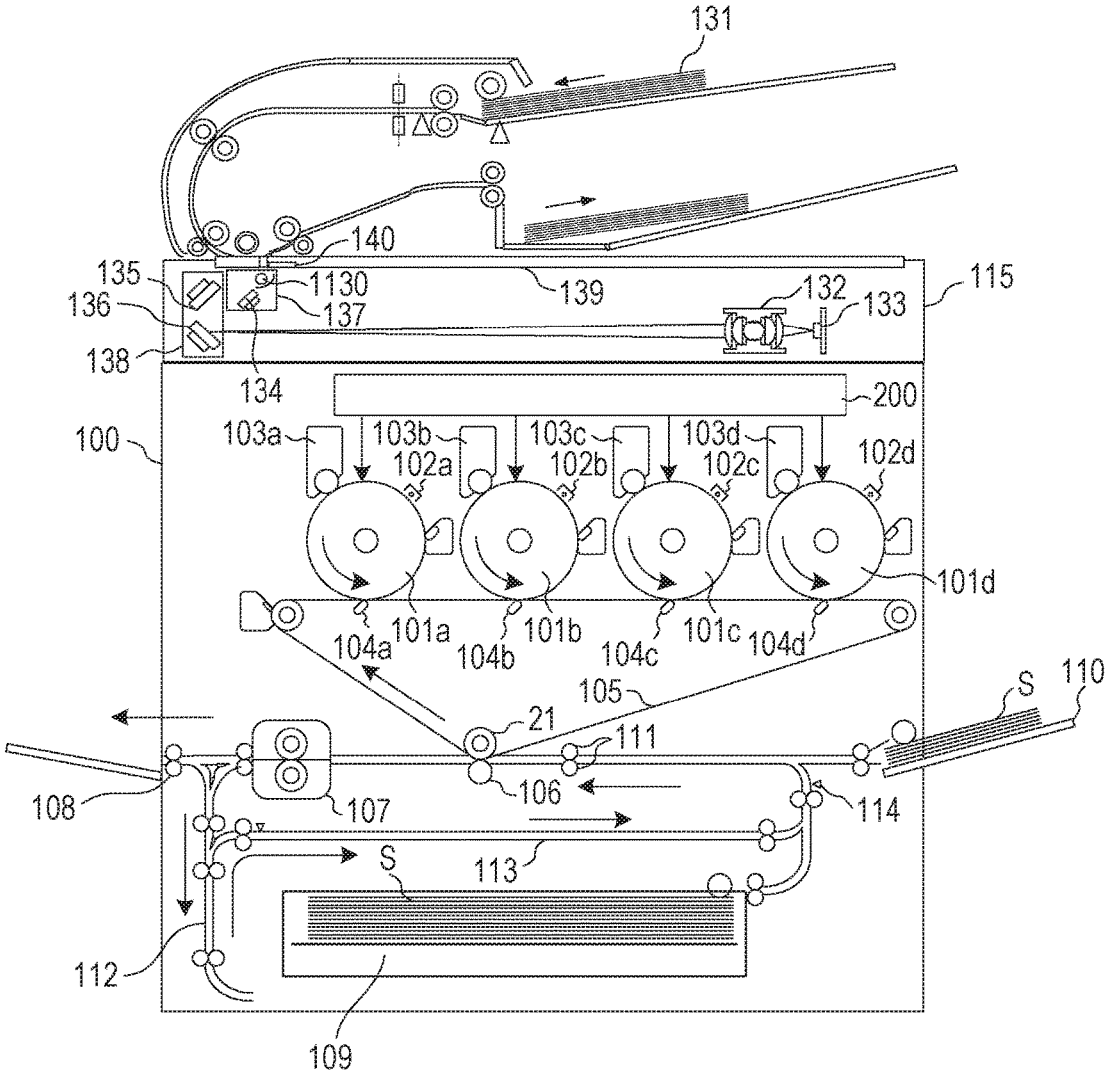
FIG. 1 is a diagram illustrating a configuration of an image forming apparatus according to first to third embodiments.

FIG. 1 is a cross-sectional view of an entire configuration of an image forming apparatus 100, that is, a full-color printer employing an electrophotographic method, according to first to third embodiments. In the image forming apparatus 100 of FIG. 1, photoconductive drums 101*a* to 101*d* which are photoconductors corresponding to different colors are charged by chargers 102*a* to 102*d*, respectively. Here, indices a to d of the reference numerals indicate colors of yellow (Y), magenta (M), cyan (C), and black (K), and are omitted hereinafter unless a member of a specific color is described. The charged photoconductive drums 101 form electrostatic latent images (latent images) using laser light (light beams) emitted from a single optical scanning apparatus 200 having a light emitting element serving as a light source. An amount of laser light is appropriately controlled depending on an environment of a location where the image forming apparatus 100 is installed and the number of years in use of the photoconductive drums 101, so that latent images having an appropriate potential are formed on the photoconductive drums 101. The electrostatic latent images formed on the photoconductive drums 101 are developed by developer devices 103 serving as developing units using toner. Then toner images of different colors developed on the photoconductive drums 101 are transferred to a belt 105 serving as a bearing member in an overlapping manner by a transfer voltage applied to transfer rollers 104 serving as transfer units so that a color toner images are formed on the belt 105. The toner images transferred on the belt 105 are transferred on a sheet S serving as a recording member using a secondary transfer roller 106 such that the four colors are integrally transferred. Thereafter, the sheet S which supports the unfixed toner image is discharged out of the image forming apparatus 100 by a discharging roller 108 after being subjected to a fixing process performed by a fixing device 107 serving as a fixing unit.

The sheet S is conveyed from a sheet feeding cassette 109, a manual sheet feeding tray 110, or the like, and a registration roller 111 controls a conveying timing. The sheet S is conveyed to a nip portion formed by the secondary transfer roller 106 and an inner transfer roller 21 while a timing of the conveyance is controlled by the registration roller 111. In both-sided printing, the sheet S which has passed the fixing device 107 is guided toward a both-sided inversion path 112 so that a conveyance direction is reversed, that is, the sheet S is conveyed in an opposite direction to a both-sided path 113. The sheet S conveyed to the both-sided path 113 is conveyed to the registration roller 111 again by a vertical path roller 114, and as with a first surface, an image is formed, transferred, fixed on a second surface of the sheet S to be discharged.

Image Reading Device

The image forming apparatus 100 includes an image reading device 115 in an upper portion thereof. The image reading device 115 includes a lamp 1130 which emits light on a document plane and mirrors 134 to 136 which guide light reflected from a document 131 to a lens 132 and a charge-coupled device (CCD) line sensor 133. The lamp 1130 and the mirror 134 are mounted on a first mirror supporting portion 137. The mirrors 135 and 136 are mounted on a second mirror supporting portion 138. The first and second mirror supporting portions 137 and 138 are connected to a driving motor, not illustrated, using wire, not illustrated, and are moved in parallel to an original platen glass 139 by rotational driving of the driving motor. Furthermore, a reference white board 140 which serves as a reference of read brightness is mounted on an end of the original platen glass 139. The light reflected from the document 131 is guided to the lens 132 through the mirrors 134 to 136 and forms an image on a light receiving section of the CCD line sensor 133 using the lens 132. The CCD line sensor 133 performs photoelectric conversion on the reflected light which forms the image using a light receiving element and outputs an electric signal corresponding to an amount of incident light. In a case where the sheet S which is a transfer member on which toner patterns for density detection are formed by the image forming apparatus 100 is to be read by the image reading device 115, the sheet S is placed on the original platen glass 139 such that a plane on which the toner patterns for density detection are formed faces the original platen glass 139. The toner patterns for density detection (toner images for density detection) are formed by toner images having different density levels. The toner patterns for density detection will be described in detail hereinafter.

Configuration of Optical Scanning Apparatus

Figure 2A:
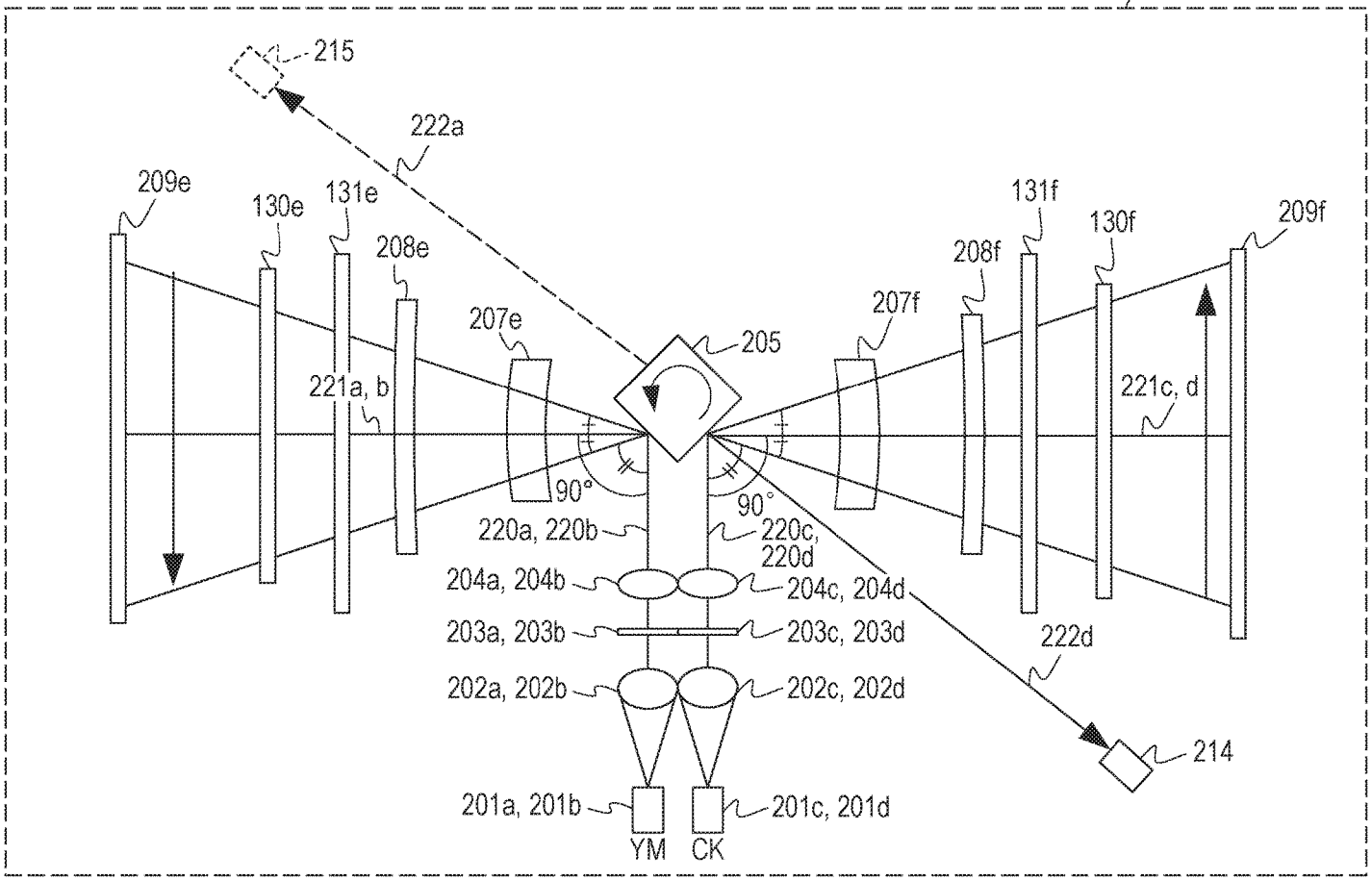
FIGS. 2A to 2C are diagrams illustrating a configuration of an optical scanning apparatus according to the first to third embodiments.
Figure 2B:
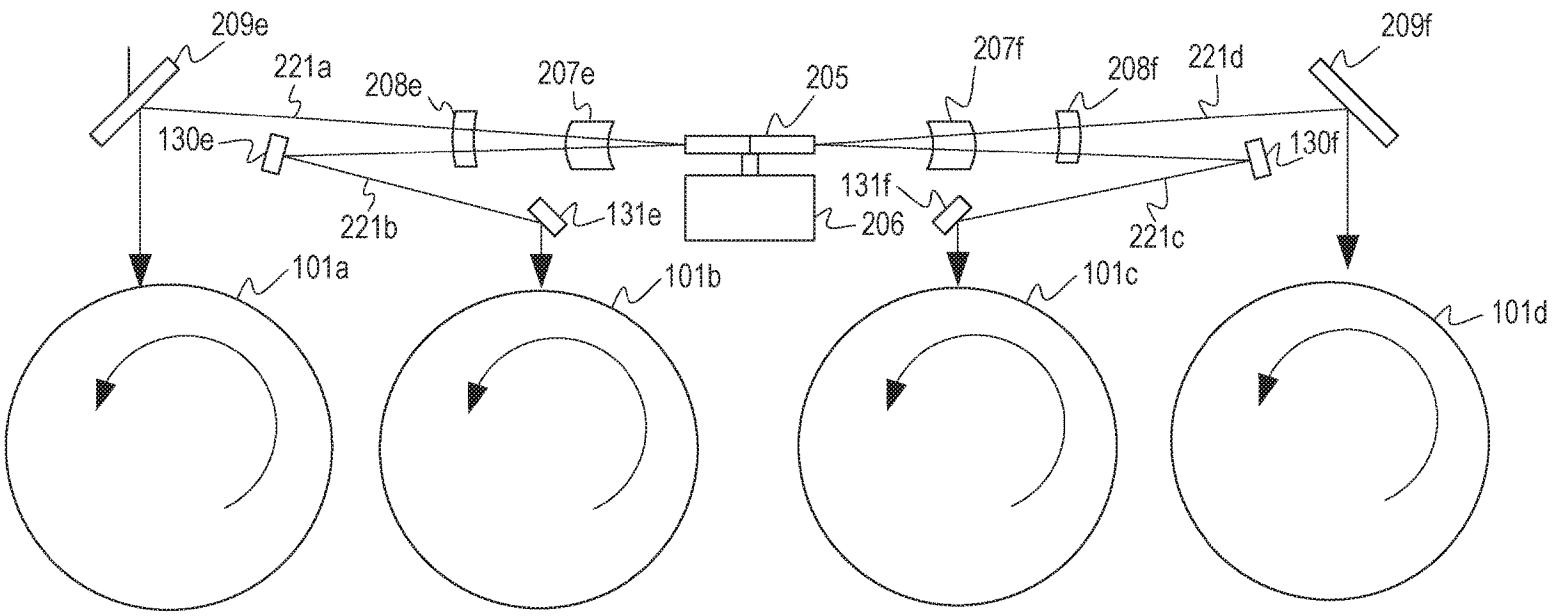
Figure 2C:
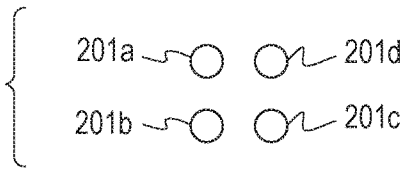

FIGS. 2A to 2C are diagrams schematically illustrating a configuration of the optical scanning apparatus 200 used in the image forming apparatus 100 according to the first to third embodiments. FIG. 2A is a diagram illustrating the optical scanning apparatus 200 serving as an exposure unit viewed from an upper side of a rotatable polygonal mirror 205 serving as a deflection unit. FIG. 2B is a side view of the optical scanning apparatus 200. FIG. 2C is a diagram illustrating a configuration of a laser diode (LD) 201 serving as light emitting elements. The optical scanning apparatus 200 includes four LDs 201. For example, the optical scanning apparatus 200 includes an LD 201*a* for yellow, an LD 201*b* for magenta, an LD 201*c* for cyan, and an LD 201*d* for black. The optical scanning apparatus 200 includes the LD 201, collimator lenses 202, aperture stops 203, and cylindrical lenses 204. The optical scanning apparatus 200 further includes the rotatable polygonal mirror 205, a scanner motor 206, toric lenses 207*e* and 207*f*, diffraction optical elements 208*e* and 208*f*, and reflecting mirrors 209*e*, 209*f*, 130*e*, 130*f*, 131*e*, and 131*f*. The collimator lenses 202 convert light beams emitted from the LD 201 into parallel light fluxes. The aperture stops 203 restrict the light fluxes of the light beams which pass the aperture stops 203. The cylindrical lenses 204 have a predetermined refracting power (a degree of refraction) only in the sub-scanning direction and form oval images having longer diameters in the main scanning direction on a reflection plane of the rotatable polygonal mirror 205 using the light fluxes. A light path of the laser light of Y from the LD 201 to the rotatable polygonal mirror 205 and a light path of the laser light of K are in parallel to each other and a light path of the laser light of M and a light path of the laser light of C are in parallel to each other. Furthermore, the laser light of Y and M and the laser light of C and K are symmetrically incident on the plane of the rotatable polygonal mirror 205.

The rotatable polygonal mirror 205 is rotated by the scanner motor 206 at a constant speed in a direction denoted by an arrow mark in FIG. 2A, and deflects and scans the laser light which forms the image on the reflection plane. Here, in the rotatable polygonal mirror 205, scanning is performed using the light beams of Y and M on a left side and using the light beams of C and K on a right side. Here, positions in which light beams are reflected by 90 degrees viewed from the LD 201 corresponds to centers of the photoconductive drums 101 to be set in centers of images (FIG. 2A). Specifically, light beams are emitted on the centers of the photoconductive drums 101 as follows. Light beams 220 which are emitted from the LD 201 are incident on the rotatable polygonal mirror 205 at an angle of 45 degrees and reflected by the rotatable polygonal mirror 205 in a direction inclined by 90 degrees relative to the light paths of the incident light beams 220.

Light beams 221*a* and 221*b* reflected by the rotatable polygonal mirror 205 pass the toric lens 207*e* and the diffraction optical element 208*e*. Thereafter, the light beam 221*a* is reflected by the reflecting mirror 209*e* and finally irradiated in the main scanning direction on the photoconductive drum 101*a*. Meanwhile, the light beam 221*b* is reflected by the reflecting mirrors 130*e* and 131*e* and finally irradiated in the main scanning direction on the photoconductive drum 101*b*. The light beams 221*a* and 221*b* are incident on identical positions in the main scanning direction on the photoconductive drums 101*a* and 101*b*, respectively. Furthermore, light beams 221*c* and 221*d* reflected by the rotatable polygonal mirror 205 pass the toric lens 207*f* and the diffraction optical element 208*f*. Thereafter, the light beam 221*d* is reflected by the reflecting mirror 209*f* and finally irradiated in the main scanning direction on the photoconductive drum 101*d*. Meanwhile, the light beam 221*c* is reflected by the reflecting mirrors 130*f* and 131*f* and finally irradiated in the main scanning direction on the photoconductive drum 101*c*. The light beams 221*c* and 221*d* are incident on identical positions in the main scanning direction on the photoconductive drums 101*c* and 101*d*, respectively.

The toric lenses 207 are optical elements which have an fθ characteristic and are refraction units having different refraction factors in the main scanning direction and the sub-scanning direction. Both lens surfaces, that is, a front surface and a back surface, of each of the toric lenses 207 in the main scanning direction have an aspherical shape. The diffraction optical elements 208 are optical elements having an fθ characteristic and are long diffraction units having different magnifications in the main scanning direction and the sub-scanning direction. A black light beam 222*d* which is used in the scanning performed by the rotatable polygonal mirror 205 is incident on a BD 214 serving as a detection unit and is used for detection of a timing of scanning light. The BD 214 generates a scanning timing signal (BD signal) when receiving the light beam 222*d*. Image forming using the laser light of C and K is performed at a timing when the BD 214 detects the light beam 222*d*, and image rendering is started when a predetermined period of time has elapsed after the BD signal is generated. Similarly, as for image forming using the laser light of Y and M, image rendering is started based on the BD signal generated by the BD 214. When images of Y and M light beams are to be written, assuming that a BD 215 is provided, the images are rendered by scanning in a direction opposite to a scanning direction of the C and K laser beams at a timing when the BD 215 generates a virtual BD signal. A plane of the rotatable polygonal mirror 205 used when the BD 214 generates a BD signal at a certain timing is different from a plane of the rotatable polygonal mirror 205 used when scanning is performed using the Y and M light beams at the same timing. Therefore, the virtual BD signal generated by the virtual BD 215 is used to perform positioning of images of the different colors by adding or subtracting a predetermined period of time to or from a writing time of an actual BD signal generated by the BD 214.

FIG. 2B is a diagram illustrating the optical scanning apparatus 200 viewed from a font of the image forming apparatus 100. In the photoconductive drums 101, in scanning of the rotatable polygonal mirror 205 in the main scanning direction, spots of the light beams emitted from the LD 201 are linearly moved in parallel to rotation axes of the photoconductive drums 101. Since the photoconductive drums 101 are driven to be rotated, images are written in the main scanning direction and loops back in the sub-scanning direction which is opposite to the main scanning direction. After surfaces of the photoconductive drums 101 are charged by the chargers 102, the charged surfaces of the photoconductive drums 101 are scanned using the light beams. Potentials of the surfaces of the photoconductive drums 101 are changed due to intensity of the emitted light beams.

Configuration of Light Emitting Element

Figure 3A:
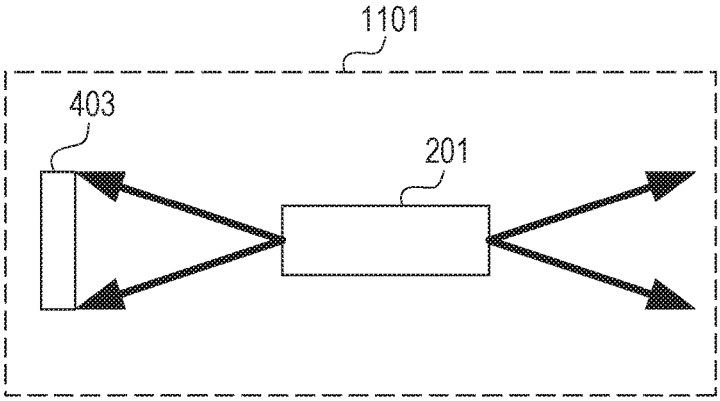
FIGS. 3A to 3C are diagrams illustrating a configuration of a semiconductor laser element and auto light power control (APC) according to the first to third embodiments.
Figure 3B:
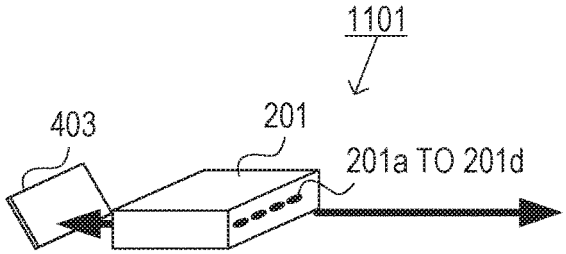

FIG. 3A is a diagram illustrating a configuration of a semiconductor laser element 1101, and FIG. 3B is a diagram illustrating the configuration of the semiconductor laser element 1101 viewed from the LD 201. The LD 201 corresponds to a laser chip including four light sources, that is, the LDs 201*a* to 201*d*. Furthermore, the LD 201 emits light beams to a photodiode (PD) 403 from a side opposite to a side from which light beams to be incident on the photoconductive drums 101 are emitted.

Auto Power Control (APC)

Figure 3C:
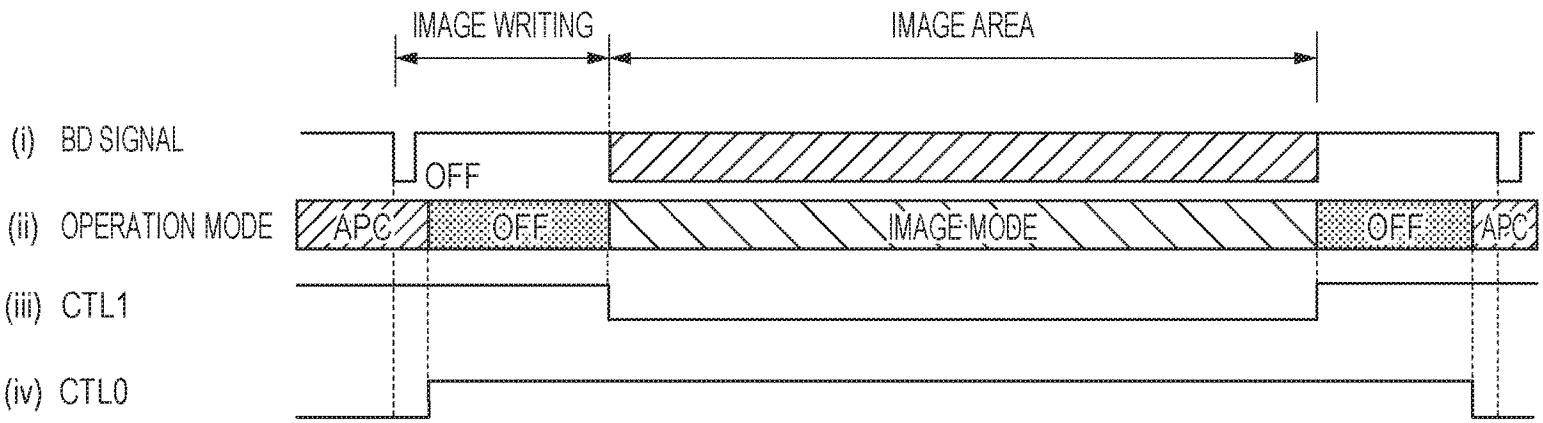

The optical scanning apparatus 200 performs power control to emit a fixed amount of light beam on planes of the photoconductive drums 101 when the optical scanning apparatus 200 is assembled. As an amount of laser light at the time of power control, a maximum amount of light required for image forming is controlled. First, a method for controlling an amount of light beam will be described. The LD 201 is configured as illustrated in FIGS. 3A to 3C. Examples of the light beam include light beams emitted rightward in FIG. 3A which are referred to as "front light" to be used for image forming and light beams emitted leftward in FIG. 3A, that is, in a direction opposite to the direction of emission of the front light, which are referred to as "rear light". The rear light is emitted by a light amount of a certain rate of the front light. The PD 403 receives the rear light emitted from the LD 201. An amount of current supplied to the LD 201 is subjected to feedback control by monitoring intensity of the light received by the PD 403. Specifically, the amount of current to be supplied to the LD 201 is controlled such that an output of the PD 403 which is a light amount detection unit attached to the LD 201 becomes a predetermined value. Such control is referred to as the auto power control (APC). Furthermore, an operation mode of the APC is referred to as an APC mode. While an image is rendered (in an image mode), light beams are repeatedly blinking, and therefore, the APC operation may not be performed. Accordingly, the APC operation is performed at a predetermined timing while an image is not rendered, that is, a predetermined timing in a non-image area. Furthermore, a laser controller 304 turns on a switch 307 in the non-image area (refer to FIG. 4).

Control Circuit

Figure 4:
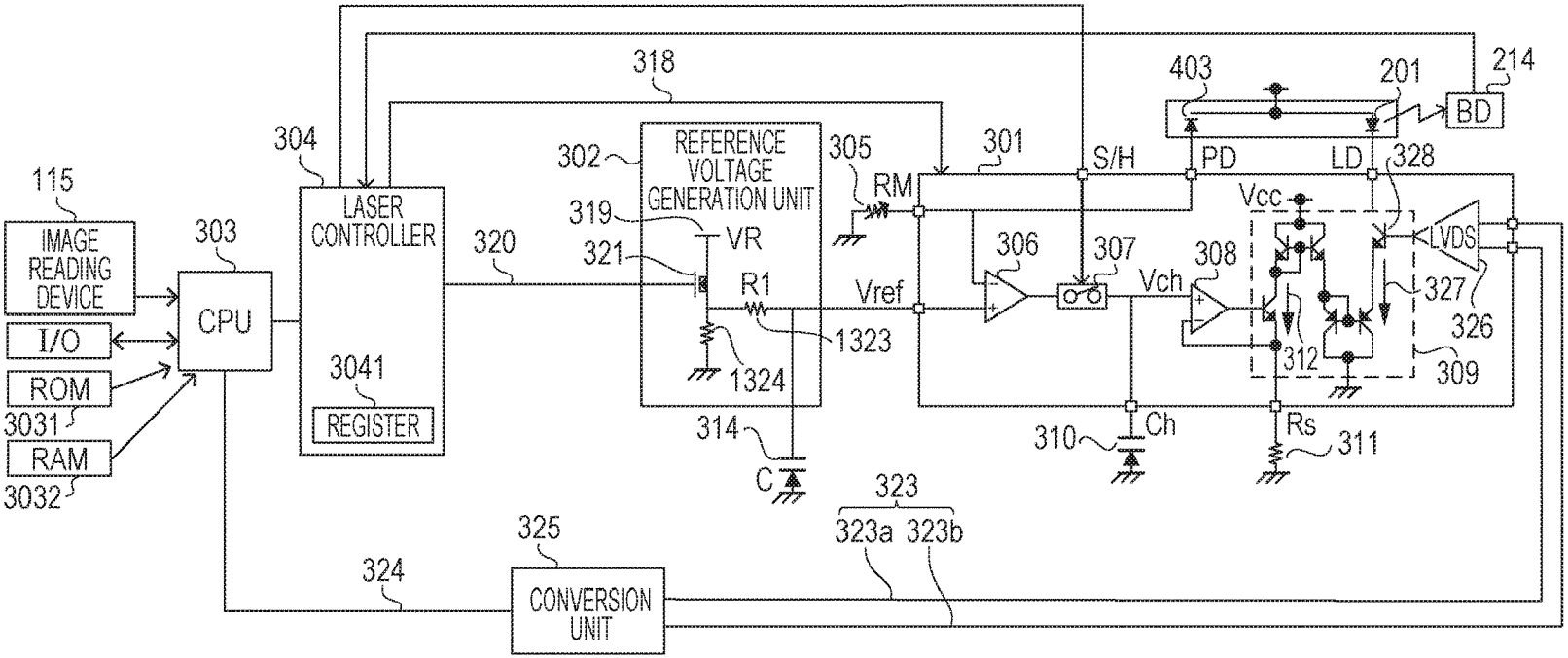
FIG. 4 is a diagram illustrating a light amount control circuit according to the first to third embodiments.
Figure 5:
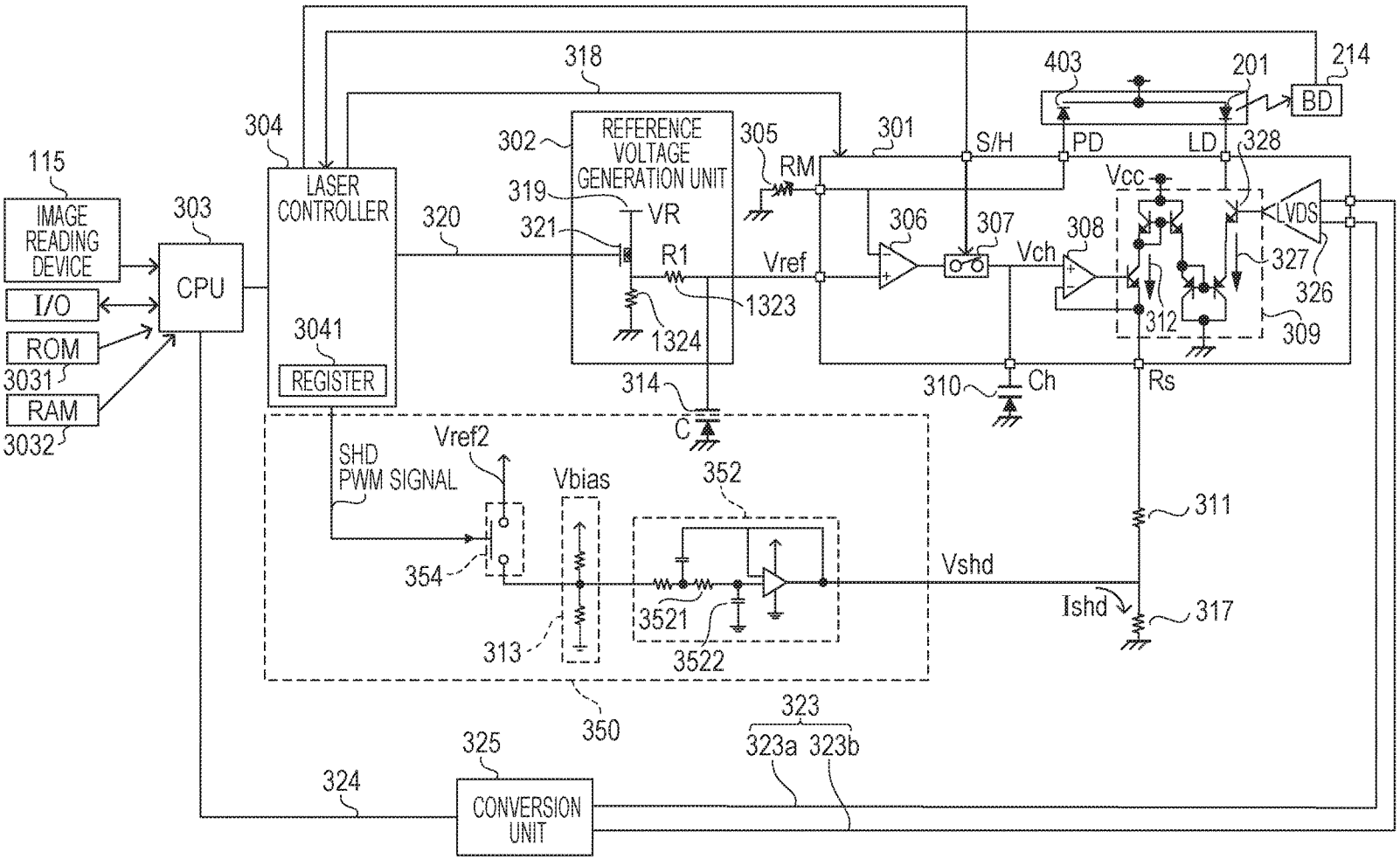
FIG. 5 a diagram illustrating a light amount control circuit according to the first to third embodiments.

A method for performing switching between the APC mode and the image mode will be described with reference to block diagrams of a control circuit illustrated in FIGS. 4 and 5. FIG. 5 is a block diagram illustrating a control circuit including a shading circuit 350. On the other hand, FIG. 4 is a block diagram illustrating a control circuit which does not include a shading circuit. The same reference numerals are assigned to the same components in FIGS. 4 and 5, and the following description is made with reference to FIG. 5. A central processing unit (CPU) 303 serving as a control unit performs a setting for outputting a laser control signal 318 used to control an APC circuit 301 on the laser controller 304. The laser controller 304 is an application specific integrated circuit (ASIC), for example, and generates the laser control signal 318 based on a setting value set in a register 3041 by the CPU 303. Note that the CPU 303 and the laser controller 304 may be configured as a single IC.

The laser control signal 318 is constituted by parallel signals of several bits which are referred to as a CTL signal and are used to change a control mode by patterns of the parallel signals. The change of the control mode is performed for each laser scanning. The register 3041 included in the laser controller 304 stores information on Table 1 below.

TABLE 1

| | DISABLING MODE | APC MODE | IMAGE MODE | OFF MODE |
|---|---|---|---|---|
| CTL1 | L | H | L | H |
| CTL0 | L | L | H | H |

The laser controller 304 outputs the laser control signal 318 (CTL1 and CTL0) illustrated in FIG. 3C based on Table 1.

In a disabling mode, the image forming apparatus 100 is turned off (OFF) or the image forming apparatus 100 enters an image forming job waiting state. In the disabling mode, as a status of the laser control signal 318, the signal CTL1 is in a low level (L) and the signal CTL0 is in a low level (L). When the signals CTL1 and CTL0 of the laser control signal 318 which are in the low level are supplied to the APC circuit 301, the APC circuit 301 discharges a hold capacitor (hereinafter simply referred to as "capacitor") 310 so that a voltage Vch of the capacitor 310 becomes 0 V. Since the voltage Vch of the capacitor 310 is 0 V, potentials of opposite ends of a current restriction resistor 311 become 0 V. Therefore, a driving current 312 and a current 327 are not supplied to a current mirror circuit 309.

In the APC mode, as a status of the laser control signal 318, the signal CTL1 is in a high level (H) and the signal CTL0 is in a low level (L). When the signals CTL1 and CTL0 of the laser control signal 318 which are in the high level and the low level, respectively, are supplied to the APC circuit 301, the APC circuit 301 turns on a transistor 328 irrespective of an output of an LVDS buffer 326.

In the image mode, as a status of the laser control signal 318, the signal CTL1 is in a low level (L) and the signal CTL0 is in a high level (H). When the signals CTL1 and CTL0 of the laser control signal 318 which are in the low level and the high level, respectively, are supplied to the APC circuit 301, the APC circuit 301 turns on or off the transistor 328 in accordance with an output of the LVDS buffer 326.

In the OFF mode, as a status of the laser control signal 318, the signal CTL1 is in a high level (H) and the signal CTL0 is in a high level (H). When the signals CTL1 and CTL0 of the laser control signal 318 which are in the high level are supplied to the APC circuit 301, the APC circuit 301 turns off the transistor 328 irrespective of an output of the LVDS buffer 326. Hereinafter, a mode change to the APC mode performed for each scanning period of the laser light is referred to as "interline APC". The interline APC will be described with reference to FIG. 3C.

InterLine APC

In FIG. 3C, a BD signal (i) which is generated by the BD 214, becomes a high level in a state in which light beams are not received and becomes a low level in a state in which the light beams are received. A period of time from when a BD signal falls to when a next BD signal falls is referred to as a "BD period" which corresponds to a period of time required for one scanning process using light beams. The BD period includes regions on the photoconductive drums 101 (the photoconductors) which receive light beams corresponding to image data, that is, image areas corresponding to regions on which toner image are formed. Note that an interval from when a BD signal falls to when the image areas are started is referred to as an "image writing interval". In FIG. 3C, the operation mode (ii) includes the APC mode, the image mode, and the OFF mode. In FIG. 3C, the signal CTL1 (iii) is a signal of a second bit when the laser control signal 318 is constituted by the parallel signals of two bits, for example. In FIG. 3C, the signal CTL1 (iv) is a signal of a first bit when the laser control signal 318 is constituted by parallel signals of two bits, for example. Axes of abscissae indicate time.

When the operation mode is the APC mode, the laser control signal 318 has the signal CTL0 in a low level (L) and the signal CTL1 in a high level. When the operation mode is the APC mode (CTL0: L, CTL1: H), laser light is incident on the BD 214 so that a BD signal is generated ((i) in FIG. 3C). When a predetermined period of time has elapsed after the timing when the BD 214 generates the BD signal, the operation mode is switched to the OFF mode. When the operation mode is the OFF mode, the laser control signal 318 has a pattern that the signal CTL0 is in a high level and the signal CTL1 is in a high level. When a period of time in which the image area is reached is elapsed after the timing when the BD signal is generated, the signal CTL0 becomes the high level and the signal CTL1 becomes the low level in the laser control signal 318, that is, the operation mode is switched to the image mode. After the image area is terminated, the operation mode is switched to the OFF mode (CTL0: H, CTL1: H), and the operation mode is switched to the APC mode again (CTL0: L, CTL1: H) before the BD period is elapsed.

APC Mode

When the signal CTL0 is in a low level and the signal CTL1 is in a high level in the laser control signal 318, the operation mode is the APC mode. In this case, when laser light is incident on the PD 403, a current PD is supplied in accordance with an amount of the laser light incident on the PD 403. A reference voltage Vref determined by a reference voltage generation unit 302 is supplied to a positive terminal of a comparator 306. Furthermore, a voltage RM obtained when the current PD is supplied to a predetermined pre-set resistor 305 is input to a negative terminal of the comparator 306. The comparator 306 compares the reference voltage Vref and the voltage RM with each other and controls current to be supplied to the LD 201 such that the voltage RM becomes equal to the reference voltage Vref generated by the reference voltage generation unit 302. The capacitor 310 is charged such that a voltage Vch which determines current obtained when the APC is performed so that a light amount of the LD 201 become a target light amount. The voltage Vch is supplied to a positive terminal of an operational amplifier 308. Furthermore, a voltage RS obtained by converting current supplied to the current restriction resistor 311 is input to a negative terminal of the operational amplifier 308. The operational amplifier 308 and the current restriction resistor 311 convert the voltage Vch into the driving current 312 in accordance with the voltage Vch. The current mirror circuit 309 generates current which is equivalent to the driving current 312 using the driving current 312 and supplies the generated current as a current Ild 327 to the LD 201 when the transistor 328 is in an on state.

OFF Mode

When the signal CTL0 is in a high level and the signal CTL1 is in a high level in the laser control signal 318, the operation mode is the OFF mode. In this case, the LD 201 is in a turning-off (OFF) state. In the OFF mode, the capacitor 310 maintains a charged state.

Image Mode

When the signal CTL0 is in a high level and the signal CTL1 is in a low level in the laser control signal 318, the operation mode is the image mode. In this case, current is supplied to the LD 201 in accordance with an image signal while the voltage Vch is maintained by a charging voltage Ch of the capacitor 310. Furthermore, in the image mode, the CPU 303 outputs image data 324 to a conversion unit 325. Here, the image data 324 is bitmap data or the like of four bits supplied from a controller unit, not illustrated, to the CPU 303, for example, and includes gradation data. The conversion unit 325 converts the input image data 324 into a PWM signal having a pulse width (on width: a period of time required for emitting light from the LD 201) suitable for characteristics of the LD 201. For example, the conversion unit 325 converts the image data 324 into a PWM signal 323 corresponding to gradation of pixels of the image data 324 and outputs the PWM signal 323 to the APC circuit 301.

When receiving the PWM signal 323 corresponding to density of pixels, the APC circuit 301 turns on and off a laser driving current (the current 327) in accordance with the PWM signal 323 in the image mode. By this, the LD 201 emits light or is turned off. The CPU 303 outputs the image data 324 which has been subjected to a screen process and γ correction to the conversion unit 325. The conversion unit 325 generates the PWM signal 323 corresponding to the image data 324 using a predetermined table (ILUT), described below, in which the image data 324 and a PWM pattern are associated with each other. The PWM signal 323 defines a period of time in which the LD 201 emits light in on pixel (the on width), and is supplied to the APC circuit 301 described below as differential signals 323*a* and 323*b* which are inverted from each other. The PWM signal 323 is generally supplied to the APC circuit 301 by transmission employing a low voltage differential signaling (LVDS) method. The APC circuit 301 includes the LVDS buffer 326, returns the PWM signal 323 as a single-end signal using the LVDS buffer 326, and performs turning-on (light emission) and turning-off (light off) (switching) of the LD 201 using a driving current corresponding to a controlled light amount.

Disabling Mode

A state in which the signal CTL0 is in a low state and the signal CTL1 is in a low state corresponds to a state in which a value of a light amount of the LD 201 in the APC is returned to 0, and this operation is referred to as a "disabling mode". In the disabling mode, charge of the capacitor 310 is discharged so that the voltage Vch of 0 is attained and the LD 201 is turned off. When printing on the sheet S is terminated, and therefore, the output of the LD 201 is to be stopped, the disabling mode is entered in general.

The APC is required to be performed out of the image area. Therefore, the CPU 303 detects a scanning timing using the BD signal generated by the BD 214 through the laser controller 304 and controls the laser controller 304. The laser controller 304 outputs a pattern of the laser control signal 318 described above to the APC circuit 301 at a predetermined timing in accordance with the BD signal supplied from the BD 214.

Driving Current of LD

The driving current 312 will be described. The driving current 312 is determined by the voltage Vch which controls a voltage of the capacitor 310, the shading voltage (the output voltage) Vsh output from a smoothing circuit 352, a resistance value Rs of the current restriction resistor 311, and a resistance value Rt (Rt<<Rs) of a resistor 317. Here, a voltage charged and held in the capacitor 310 at the time of the APC is denoted by "Vapc". The smoothing circuit 352 is a low-pass filter included in the shading circuit 350. The smoothing circuit 352 includes an RC circuit constituted by a resistor 3521 and a capacitor 3522. The driving current 312 is represented by the following equation.

$$\text{Driving Current312} = Vapc/(Rs+Rt) - Vshd/Rt$$

Here, a current Ishd supplied from the shading circuit 350 through the resistor 317 is represented as follows: Current Ishd=Vshd/Rt.

The APC is executed in a non-image forming region in one scanning period. In the image forming region in one scanning period, the switch 307 is in an off state. Therefore, the capacitor 310 outputs a voltage Vch which has been sampled in the APC mode. Therefore, in the image forming region in one scanning period, the voltage Vch is fixed except for influence of self-discharge, and a current value of the driving current 312 is constant and is represented as follows: Vapc/(Rs+Rt).

On the other hand, the shading circuit 350 described below controls the shading voltage Vshd in accordance with an exposure position of a light beam in the main scanning direction. Accordingly, in the image forming region in one scanning period, the current Vshd/Rt is changed in accordance with an exposure position of a light beam in the main scanning direction.

In the image forming region, the current value Vapc/(Rs+Rt) is fixed, and the current value Vshd/Rt is changed in accordance with an exposure position of a light beam in the main scanning direction. Therefore, by controlling the shading voltage Vshd by an exposure position of a light beam in the main scanning direction, the driving current 312 may be controlled to have a current value corresponding to the exposure position of the light beam in the main scanning direction.

Shading Circuit

An operation of the shading circuit 350 serving as a light amount control unit will be described. The laser controller 304 reads correction values of light amounts corresponding to individual exposure positions from a read only memory (ROM) 3031 through the CPU 303. The correction values of the light amounts corresponding to the exposure positions are light amount correction data and are hereinafter referred to as "shading data". The laser controller 304 outputs a PWM signal (SHDPWM signal) including a pulse having a pulse width (a duty ratio) based on the shading data. Here, the laser controller 304 switches the shading data to be used for generation of the SHDPWM signal for each block during scanning using light beams. Then the laser controller 304 outputs SHDPWM signals having pulse widths corresponding to shading blocks.

The laser controller 304 includes a reference clock signal generation unit (hereinafter referred to as a "clock") which generates a reference clock signal having a fixed frequency and a counter which counts a reference clock signal. The reference clock signal generation unit generates a clock signal having a frequency higher than that of the BD signal (a periodic signal). The laser controller 304 counts the reference clock signal using the internal counter using the BD signal as a reference and performs switching of the shading data in accordance with a count value corresponding to a boundary of shading blocks.

A voltage switch 354 is turned on or off in accordance with the SHDPWM signal output from the laser controller 304. As illustrated in FIG. 5, a bias applying circuit 313 is disposed between the voltage switch 354 and the smoothing circuit 352. The bias applying circuit 313 applies a bias voltage Vbias which is a fixed voltage to an output (Vref2) of the voltage switch 354. When the voltage switch 354 is in an on state, a voltage Vref2+Vbias is applied to the smoothing circuit 352. A value of the bias voltage Vbias is considerably smaller than the voltage Vref2, and is fine voltage having a value equal to or larger than 0 V and pretty close to OV. When the voltage switch 354 is in an off state, the voltage Vbias is applied to the smoothing circuit 352. Accordingly, when the voltage switch 354 is turned on or off by the SHDPWM signal, an input to the smoothing circuit 352 is changed between the voltage Vref2+Vbias and the voltage Vbias. The smoothing circuit 352 outputs the shading voltage Vshd after smoothing the input. The laser controller 304 sets a duty ratio of the SHDPWM signal for each shading block so as to control the shading voltage Vshd output from the smoothing circuit 352. The shading voltage Vshd is based on the shading reference voltage Vref2, the bias voltage Vbias, and the duty ratio of the SHDPWM signal. Accordingly, a current value of the driving current 312 is controlled in accordance with positions in the main scanning direction so that the shading correction is executed.

Shading Correction Control

Figure 6:
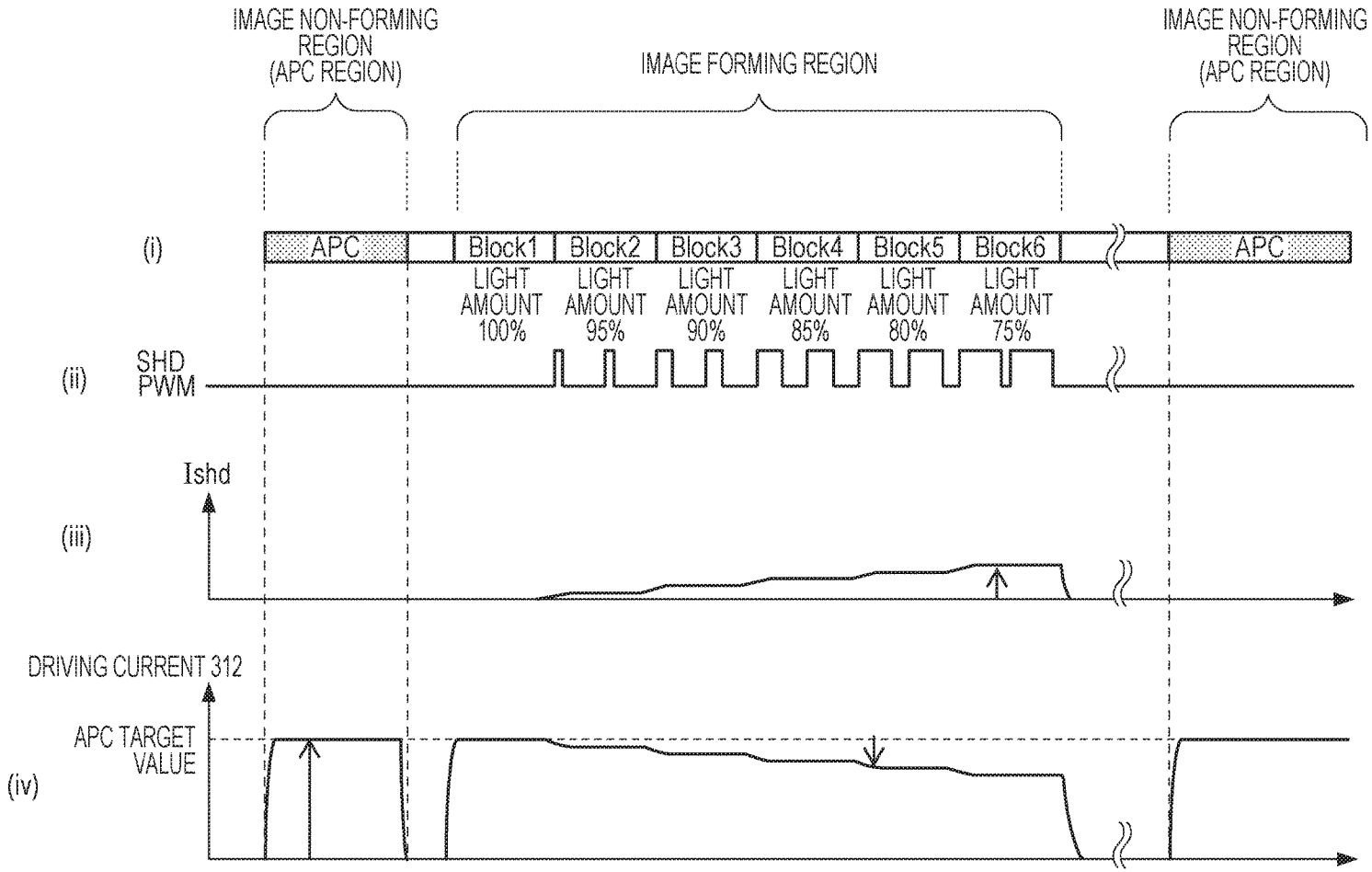
FIG. 6 is a diagram illustrating correction of an amount of laser light performed by a shading circuit according to the first to third embodiments.

Hereinafter, an operation of the shading correction control will be described in detail. FIG. 6 is a timing chart illustrating an effect obtained when an amount of laser light is corrected by the shading circuit 350. (i) indicates regions on the photoconductive drums 101 including the non-image forming region (an APC region) and the image forming region. Note that the image forming region is divided into a plurality of blocks when the shading process is performed in the main scanning direction, and is divided into six blocks in this embodiment, for example. Hereinafter, these blocks are referred to as Block 1, Block 2, and the like. (ii) indicates the SHDPWM signal output from the laser controller 304. (iii) indicates the current Ishd corresponding to the shading voltage Vshd. (iv) indicates the driving current 312. Axes of abscissae denote time. In FIG. 6, a shading operation sequence for one scanning is illustrated. In this sequence, the image forming region is divided into a plurality of blocks, and a duty ratio of the SHDPWM signal is set based on shading data of the blocks.

As described above, the driving current 312 is controlled by the shading voltage Vshd. For example, as a pulse width of the SHDPWM becomes larger, the shading voltage Vshd output from the smoothing circuit 352 becomes larger, and therefore, the driving current 312 becomes smaller and an amount of the light beam is reduced. In Block 1 of FIG. 6, for example, a duty ratio of the SHDPWM signal output from the laser controller 304 is 0%. In this case, it is assumed that a light amount is 100%. In Block 2, a duty ratio of the SHDPWM signal output from the laser controller 304 is 5% so that a light amount in Block 2 is controlled to 95% of the light amount of Block 1. Since the laser controller 304 outputs the PWM signal having the duty ratio of 5%, the driving current 312 in a period in which Block 2 is scanned is controlled and an amount of the light beam is controlled to 95%. Similarly, in Blocks 3 to 6, amounts of light beams may be controlled to be suitable for the blocks when the laser controller 304 outputs the SHDPWM signal having duty ratios corresponding to the blocks. Note that, although the SHDPWM signal in each block is represented by one pulse in FIG. 6, the laser controller 304 generates a plurality of pulses in each block in practice and the smoothing circuit 352 performs a smoothing process on the plurality of pulses.

The smoothing circuit 352 outputs the shading voltage Vshd by smoothing an input and smoothly changes a light amount among the shading blocks in the sequence described above. The smoothing circuit 352 includes a capacitor and a choke coil or a resistor and is a filter circuit including an active filter using an operational amplifier. A cutoff frequency of the active filter is set such that a frequency of the SHDPWM signal is cut and a period of the shading blocks is allowed to pass. At a timing when the pulse width of the SHDPWM signal is switched (at a timing when the shading block is switched), the voltage Vshd is changed in a curved manner without steps by the operation of the smoothing circuit 352. Specifically, streaks and unevenness are prevented from being generated on an image by suppressing dramatic change of a light amount at the timing when the pulse width of the SHDPWM is switched using the smoothing circuit 352.

Light Amount Control by Light Amount PWM Signal

A method for controlling a light amount of the LD 201 by a light amount PWM signal 320 will be described with reference to FIG. 5. The laser controller 304 outputs the light amount PWM signal 320 to a field effect transistor (FET) 321 included in the reference voltage generation unit 302. The light amount PWM signal 320 is a pulse signal which is used to determine the reference voltage Vref. The reference voltage Vref may be changed by changing a duty ratio of the light amount PWM signal 320. The reference voltage generation unit 302 converts a voltage VR 319 which is internally generated into an on/off signal when the FET 321 is turned on or off in accordance with the input light amount PWM signal 320. The voltage VR 319 is smoothed by a filter formed by a resistor R1 1323 and a capacitor C 314 so that the reference voltage Vref is generated. The comparator 306 included in the APC circuit 301 compares the reference voltage Vref with current supplied from the PD 403. By this, the light amount control may be performed. Note that a resistor 1324 is provided to bring the voltage VR 319 into a low level when the FET 321 is turned on. Furthermore, a sample-and-hold signal is supplied to the switch 307 and is used to switch the operation mode of the APC circuit 301.

Here, the light amount PWM signal 320 is used to change an amount of the LD 201. The amount of the LD 201 is controlled by controlling a resistance value of the pre-set resistor 305 while the APC is performed in a state in which a duty ratio of the light amount PWM signal 320 is set to 100% in advance in a factory. During printing, a light amount suitable for appropriate density is set by controlling a pulse width of the light amount PWM signal 320.

First Embodiment

Image Density Correction Mode

Figure 7:
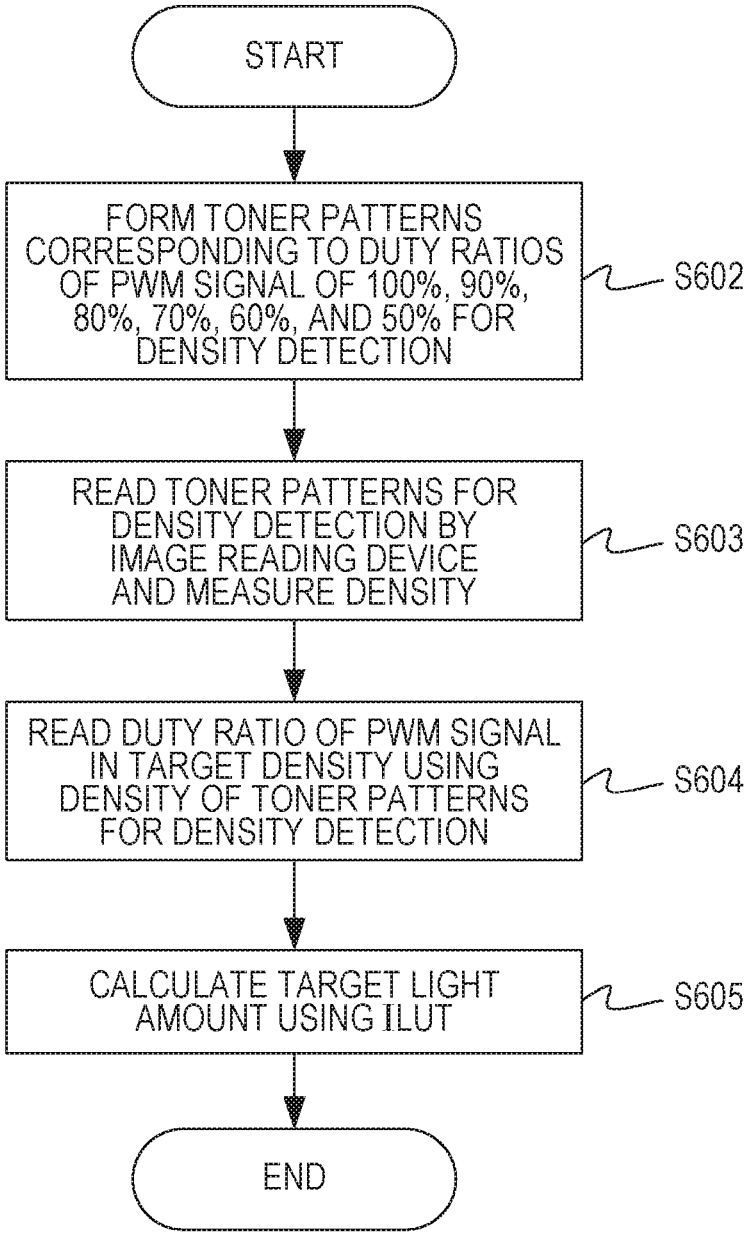
FIG. 7 is a flowchart of density correction control according to the first embodiment.
Figures 8A, 8B:
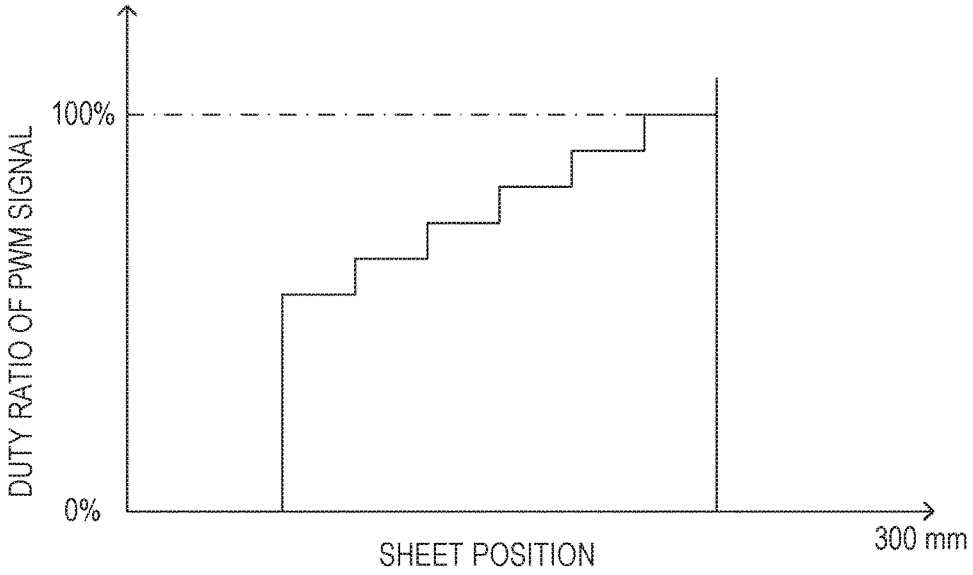
FIGS. 8A to 8C are diagrams illustrating toner patterns for density detection, duty ratios of a pulse-with-modulation (PWM) signal, and toner patterns for density detection formed on a sheet according to the first embodiment.
Figure 8C:
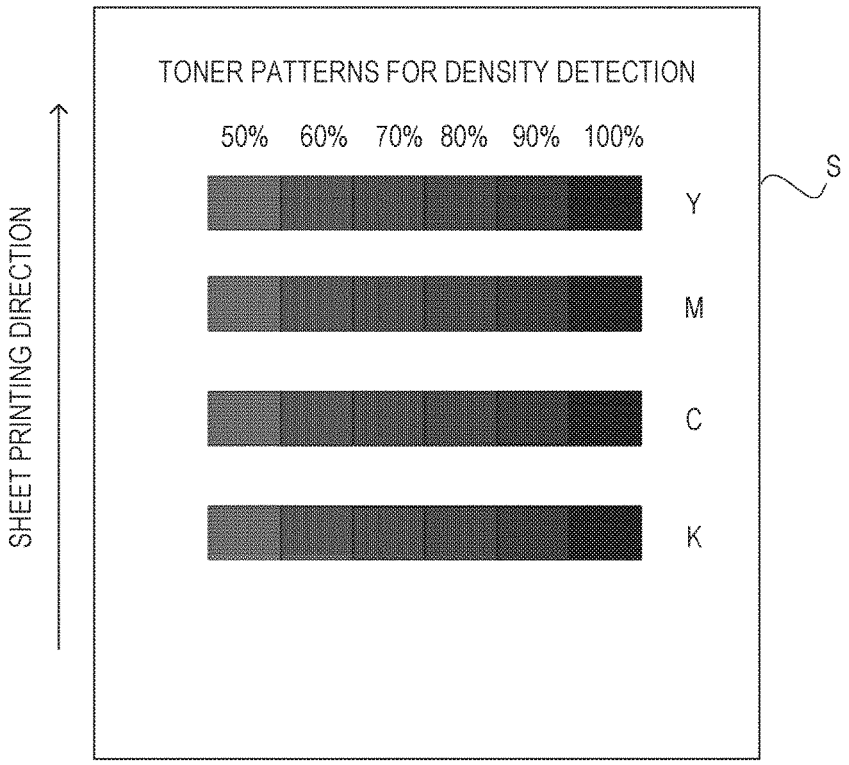

In an image density correction mode, image density is corrected by setting an amount of laser light corresponding to appropriate density even when an image forming speed of the image forming apparatus 100 is changed or when surrounding environment is changed. The image density correction mode will be described with reference to FIG. 7 and FIGS. 8A to 8C. FIG. 7 is a flowchart of control performed in the image density correction mode. FIGS. 8A to 8C are diagrams illustrating the relationship between toner patterns for density detection and the PWM signal 323. In FIG. 8A, an axis of abscissae denotes a position in the main scanning direction and an axis of ordinates denotes a duty ratio of the PWM signal 323. FIG. 8B is a diagram illustrating the toner patterns for density detection. In FIG. 8B, the toner patterns are rendered so as to correspond to a sheet position of FIG. 8A, that is, in a main scanning direction, and a direction of YMCK corresponds to a sub-scanning direction. Numerical values, such as "50%", in FIG. 8B indicate duty ratios of the PWM signal 323. The toner patterns for density detection are formed in parallel in a laser light scanning direction under an image forming condition in which a period of time in which laser light is emitted in unit time is changed. In this case, while a toner pattern of Y is formed, a charging bias of the charger 102*a* of yellow which charges the photoconductive drum 101*a* is fixed and a developing bias applied to toner by the developer device 103*a* is also fixed. This is true for the other colors. Note that a plurality of toner patterns for density detection (various colors) may be formed in parallel to the sub-scanning direction by changing the charging bias and the developing bias.

In FIG. 7, first, when the image density correction mode is started, the CPU 303 starts a process from step (S) 602. In S602, the CPU 303 causes the conversion unit 325 to output the PWM signal 323 to the APC circuit 301. A duty ratio of the PWM signal 323 is changed in accordance with a position of the sheet S in the main scanning direction as illustrated in FIG. 8A. Specifically, different duty ratios of the PWM signal 323, that is, 100%, 90%, 80%, 70%, 60%, and 50%, are set. When the duty ratio of the PWM signal 323 is 100%, for example, the LD 201 emits light for one pixel. Furthermore, when the duty ratio of the PWM signal 323 is 50%, for example, the LD 201 emits light for half of a pixel and is turned off for another half of the pixel. Note that the duty ratio of the PWM signal 323 here is different from that in image forming and is arbitrarily determined.

An image printed on the sheet S is illustrated in FIG. 8C. The image in FIG. 8C is obtained when toner patterns for density detection are printed on the sheet S (the transfer member). A direction which intersects with a sheet conveyance direction (the sub-scanning direction) in FIG. 8C, that is, a lateral direction of FIG. 8C, corresponds to the main scanning direction. Note that, in a case where the toner patterns for density detection of the sheet S are to be read by the image reading device 115 serving as a reading unit, the toner patterns for density detection are formed on the sheet S (on a recording member). In this case, an image forming section which is an image forming unit for the toner patterns for density detection includes, in addition to the optical scanning apparatus 200 and the photoconductive drums 101, the developer device 103, the transfer roller 104, and the fixing device 107. It is assumed that a duty ratio of the light amount PWM signal 320 which is output from the CPU 303 to the reference voltage generation unit 302 is 100%. Furthermore, it is assumed that, in the circuit in FIG. 5, a duty ratio of the SHDPWM signal is 0% (fixed). In S603, the CPU 303 performs density measurement based on density information obtained by reading, using the image reading device 115, the sheet S on which the toner patterns for density detection having density differences as illustrated in FIG. 8C are formed. In S604, the CPU 303 calculates a target duty ratio of the PWM signal 323 using density values of the toner patterns for density detection measured in S603 and the PWM signal 323.

Calculation of Duty Ratio of PWM Signal 323

Figure 9A:
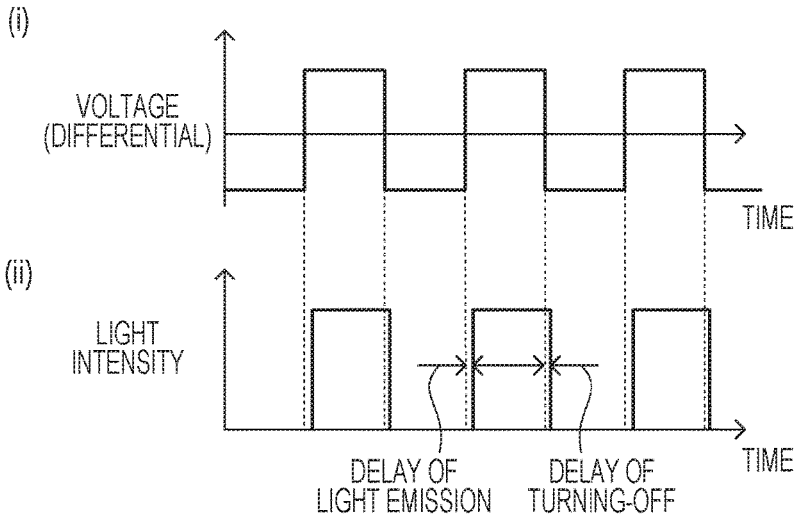
FIGS. 9A to 9C are diagrams illustrating waveforms of the PWM signal and light intensity according to the first embodiment.
Figure 9B:
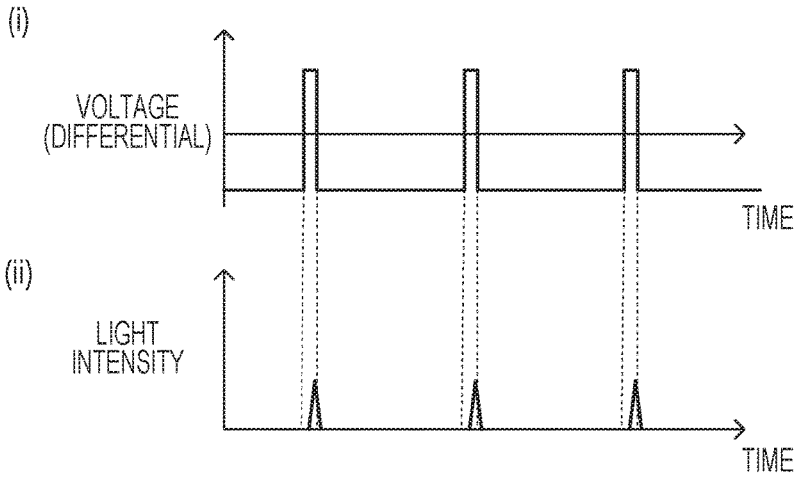
Figure 9C:
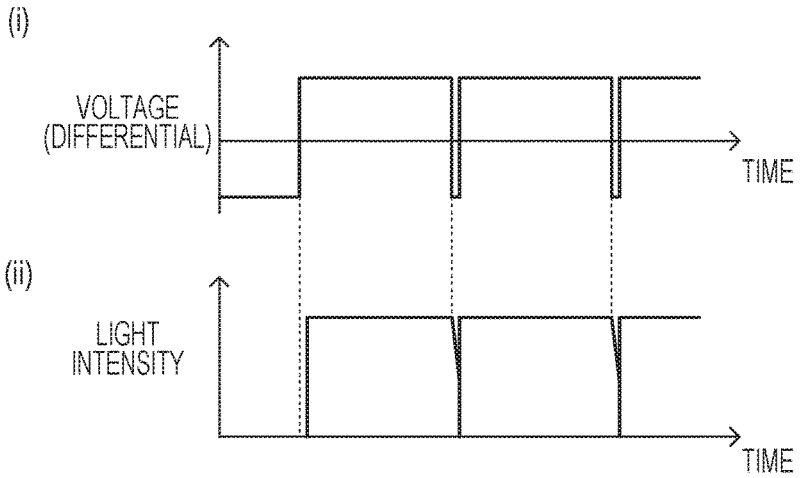

A method for calculating a duty ratio of the PWM signal 323 will now be described. In FIGS. 9A to 9C, waveforms of the PWM signal 323 are illustrated while an axis of abscissae denotes time and an axis of ordinates denotes a voltage (differential) in (i), and waveforms of laser light are illustrated while an axis of abscissae denotes time and an axis of ordinates denotes light intensity in (ii). Furthermore, a duty ratio of the PWM signal 323 is 50% in FIG. 9A, 10% in FIG. 9B, and 90% in FIG. 9C. The waveforms of the PWM signal 323 and the laser light have the relationship illustrated in FIG. 9A. Specifically, when the PWM signal 323 (*i*) applied to the LD 201 has a frequency of approximately several tens MHz, light emission delays by several ns (nanoseconds), and therefore, a waveform (ii) of the laser light is obtained in practice (delay of light emission). Similarly, the delay occurs when the laser light is turned off (turning-off delay). As a result, in duty ratios corresponding to a low current pulse, the LD 201 barely emits light as illustrated in FIG. 9B. In such a low duty ratio, although light intensity of the LD 201 is gradually increased, a duty ratio equal to that of the PWM signal 323 is not obtained. On the other hand, in a high duty ratio of the PWM signal 323, an interval in which an amount of laser light is 0 does not exist from a certain duty ratio as illustrated in FIG. 9C due to the turning-off delay of the LD 201. Note that one period of a pulse in FIGS. 9A to 9C corresponds to one pixel. In this way, a light amount per unit area of the photoconductive drums 101 is changed by controlling the duty ratio of the PWM signal 323. Therefore, density of an output image may be controlled by controlling the duty ratio of the PWM signal 323.

Figure 10A:
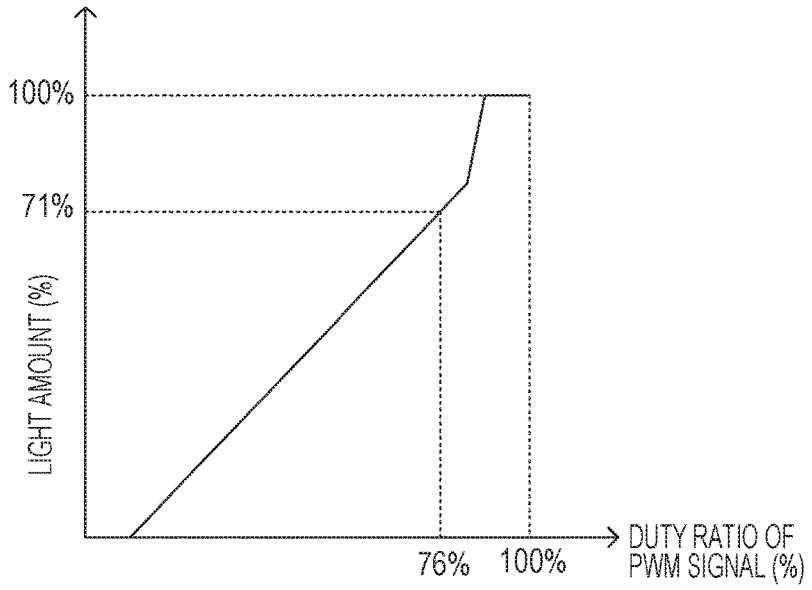
FIGS. 10A and 10B are graphs of the relationship between a duty ratio of the PWM signal and an integrated light amount, and the relationship between density of the toner patterns for density detection and the duty ratio of the PWM signal, respectively, according to the first embodiment.

FIG. 10A is a graph illustrating the relationship between the duty ratio of the PWM signal 323 and the light amount of the LD 201 which corresponds to FIGS. 9A to 9C. In FIG. 10A, an axis of abscissae denotes a duty ratio (%) of the PWM signal 323 and an axis of ordinates denotes a light emission amount (%) of the LD 201 when a tolerance output light amount of the LD 201 is set to 100%. The tolerance light amount is a value determined by design such as a specification of the LD 201, a specification of the image forming apparatus 100 (including sensitivity of photoconductive drums and maximum output density). In FIG. 10A, an axis of abscissae is also referred to as density of a toner image formed by the image forming unit when an amount of laser light is fixed and a period of time in which light beams are emitted per unit time is changed. In FIG. 10A, an axis of ordinates is also referred to as density of a toner image formed by the image forming unit when a period of time in which light beams are emitted per unit time is fixed and an amount of light beams is changed. In FIG. 10A, a condition in which density of a toner image formed when the image forming unit fixes an amount of laser light and changes a period of time in which light beams are emitted per unit time and density of a toner image formed when the image forming unit fixes a period of time in which light beams are emitted per unit time and changes an amount of light beams become equal to each other is illustrated. For example, the graph of FIG. 10A indicates that, according to the image forming apparatus 100 of this embodiment, density of a toner image formed under a condition in which an amount of laser light is 100% and a duty ratio in a period of time in which light beams are emitted is 100% is equal to density of a toner image formed under a condition in which a duty ratio in a period of time in which light beams are emitted is 76% and an amount of laser light is 71% when the charging voltage and the developing voltage. It is assumed that information on the relationship between the duty ratio of the PWM signal 323 and the light amount of the LD 201 (the relational data) illustrated in FIG. 10A is determined in advance using a result of measurement at a time of shipment, and is stored in the ROM 3031. When the duty ratio of the PWM signal 323 is low, the light amount of the LD 201 is not increased (FIG. 9B), and the light amount starts increasing in a certain duty ratio. When the duty ratio of the PWM signal 323 is high, the light amount is dramatically increased to 100% (FIG. 9C), and the light amount of the LD 201 reaches 100% before the duty ratio of the PWM signal 323 reaches 100%. Different LDs 201 have different characteristics of the light amount of the LDs 201 relative to the duty ratio of the PWM signal 323.

Figure 10B:
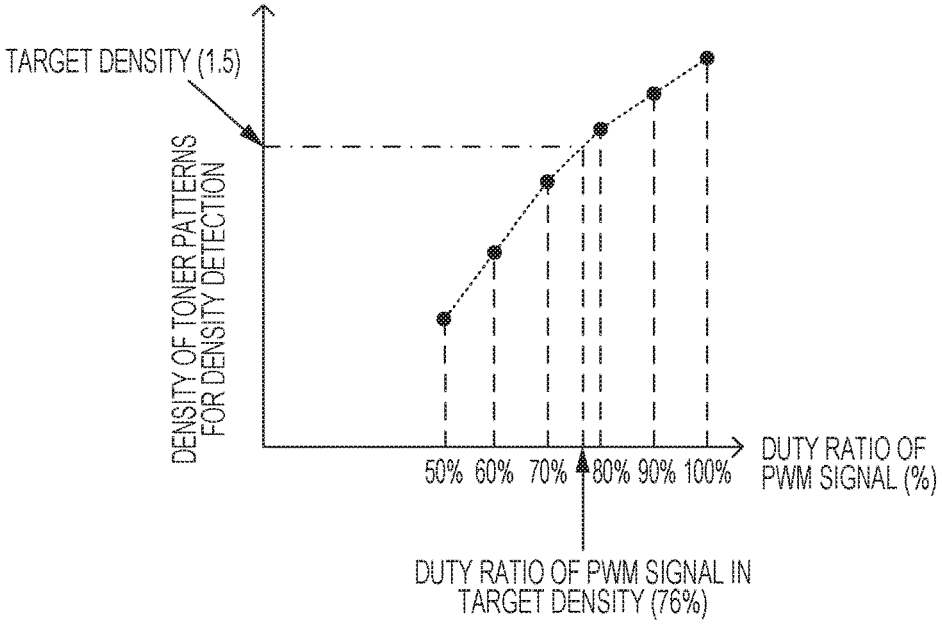

In this embodiment, the measurement of the density of the toner patterns for density detection is performed by reading the toner patterns for density detection printed on the sheet S using the image reading device 115. A result of the measurement of the density of the toner patterns for density detection is illustrated in FIG. 10B. In FIG. 10B, an axis of abscissae denotes a duty ratio of the PWM signal 323, an axis of ordinates denotes density of the toner patterns for density detection, and dots denote measured density. It is assumed here that density of a target (hereinafter referred to as a "target density") relative to a toner pattern having a highest density is 1.5. In this case, a duty ratio of the PWM signal 323 for realizing the target density of 1.5 is within a range from 70% to 80% in accordance with the measurement result. Therefore, the CPU 303 performs linear interpolation so as to obtain a duty ratio of the PWM signal 323 corresponding to the target density of 1.5. For example, a duty ratio of the PWM signal 323 corresponding to the target density of 1.5 is 76%. In this way, the CPU 303 causes the image reading device 115 to read the toner patterns for density detection formed on the sheet S as illustrated in FIG. 8C so as to obtain a duty ratio of the PWM signal 323 corresponding to the target density with reference to the relationship illustrated in FIG. 10B (S602 to S604 in FIG. 7).

Referring back to the flowchart of FIG. 7, in S605, the CPU 303 refers to an ILUT (relational data) indicating the correspondence relationship between the PWM signal 323 and an integrated light amount illustrated in FIG. 10A again. The CPU 303 determines that the target light amount is 71% when the duty ratio of the PWM signal 323 is 76% with reference to the ILUT. The CPU 303 stores the target light amount (71%, for example) in a random access memory (RAM) 3032 included in the CPU 303 and terminates the image density correction mode. The CPU 303 functions as a setting unit which sets an amount of laser light. The CPU 303 performs a printing with the target light amount (71%) stored in the RAM 3032. Here, the determined target light amount of 71% serves as a duty ratio of the light amount PWM signal 320 when an image is formed. As described above, the CPU 303 also functions as a correction unit which corrects density of an image.

According to this embodiment, the toner patterns for density detection may be formed with high accuracy in the main scanning direction and an amount of laser light may be controlled with high accuracy.

Second Embodiment

In the first embodiment, the toner patterns form density detection are formed while arbitrary duty ratios of the PWM signal 323 are set (50%, 60%, 70%, 80%, 90%, and 100%). The duty ratios of the PWM signal 323 are different from those of the PWM signal 323 obtained when image forming is performed in normal printing. In general, when receiving a print job from a personal computer or the like, the CPU 303 processes one pixel as data of four bits after performing image correction including γ correction. In this case, the duty ratio of the PWM signal 323 is determined using the relationship between the PWM signal 323 and an integrated light amount illustrated in FIG. 10A so that uniform density is obtained in 16 gradation levels from 0 to 15 for one pixel. Furthermore, as illustrated in FIG. 10A, in a range in which the duty ratio of the PWM signal 323 is smaller than approximately 10% and in a range in which the duty ratio of the PWM signal 323 is larger than 90%, the relationship between the duty ratio of the PWM signal 323 and the light amount of the LD 201 does not have linearity. Therefore, when the toner patterns for density detection are to be formed in this embodiment, the duty ratio of the PWM signal 323 in a range from 10% to 90% is used.

As a result, the relationship between the image data 324 and the duty ratio of the PWM signal 323 is illustrated as Table 2 below. Table 2 indicates the relationship between gradation (0 to 15) of the image data 324 and the duty ratio of the PWM signal 323 and is referred to as an "ILUT". For example, in Table 2, even in a gradation level is 1, the duty ratio of the PWM signal 323 is 11% which is not smaller than 10%, and even in a gradation level is 14, the duty ratio of the PWM signal 323 is 81% which is not equal to or larger than 90%.

TABLE 2

| GRADATION | DUTY RATIO |
|---|---|
| 0 | 0% |
| 1 | 11% |
| 2 | 14% |
| 3 | 18% |
| 4 | 23% |
| 5 | 28% |
| 6 | 35% |
| 7 | 39% |
| 8 | 44% |
| 9 | 49% |
| 10 | 56% |
| 11 | 63% |
| 12 | 68% |
| 13 | 75% |
| 14 | 81% |
| 15 | 84% |

Figure 11:
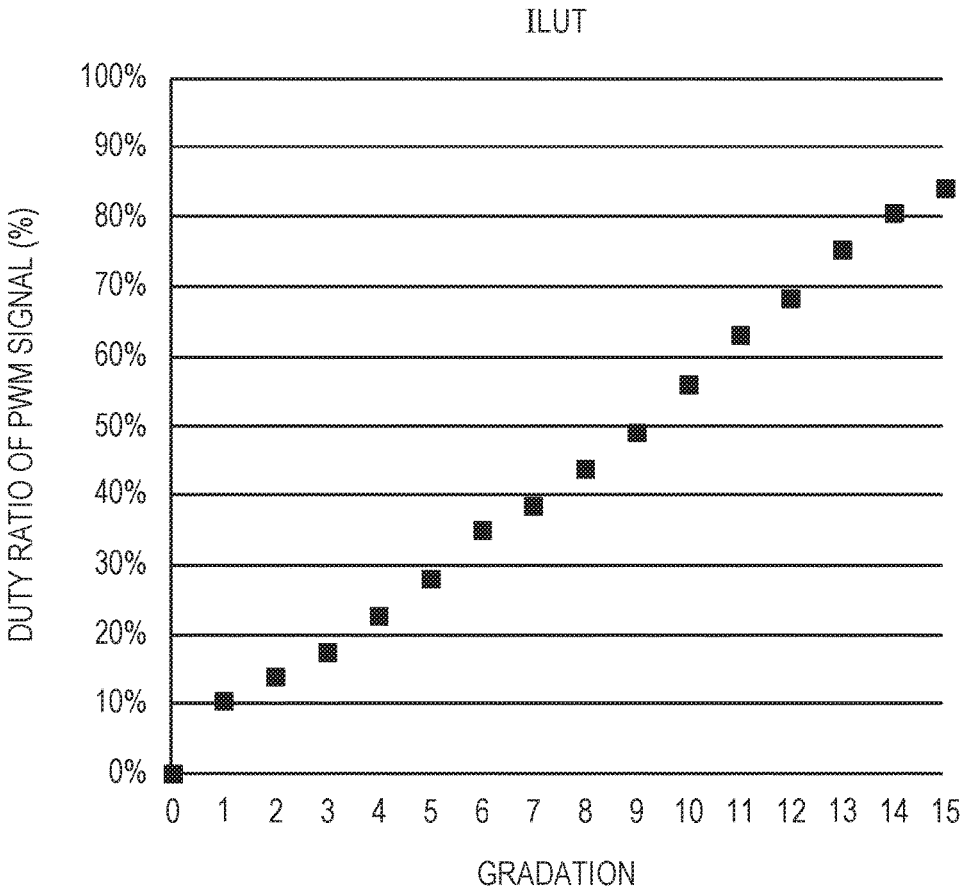
FIG. 11 is a graph of the relationship between gradation and a duty ratio of a PWM signal according to the second embodiment.

FIG. 11 is a graph of the ILUT of Table 2. In FIG. 11, an axis of abscissae denotes the gradation and an axis of ordinates denotes the duty ratio of the PWM signal 323. As illustrated in FIG. 11, the duty ratio of the PWM signal 323 may not be uniform relative to the gradation of the image data. Furthermore, a largest duty ratio of the PWM signal 323 is smaller than 90%. At a time of printing, such a duty ratio of the PWM signal 323 which is not uniform relative to the gradation is used. Therefore, although the duty ratios of the PWM signal 323 for density correction are set in a range from 0% to 100% according to the first embodiment, an image density correction mode is performed using the duty ratio of the PWM signal 323 at the time of printing in this embodiment.

Image Density Correction

Figure 12:
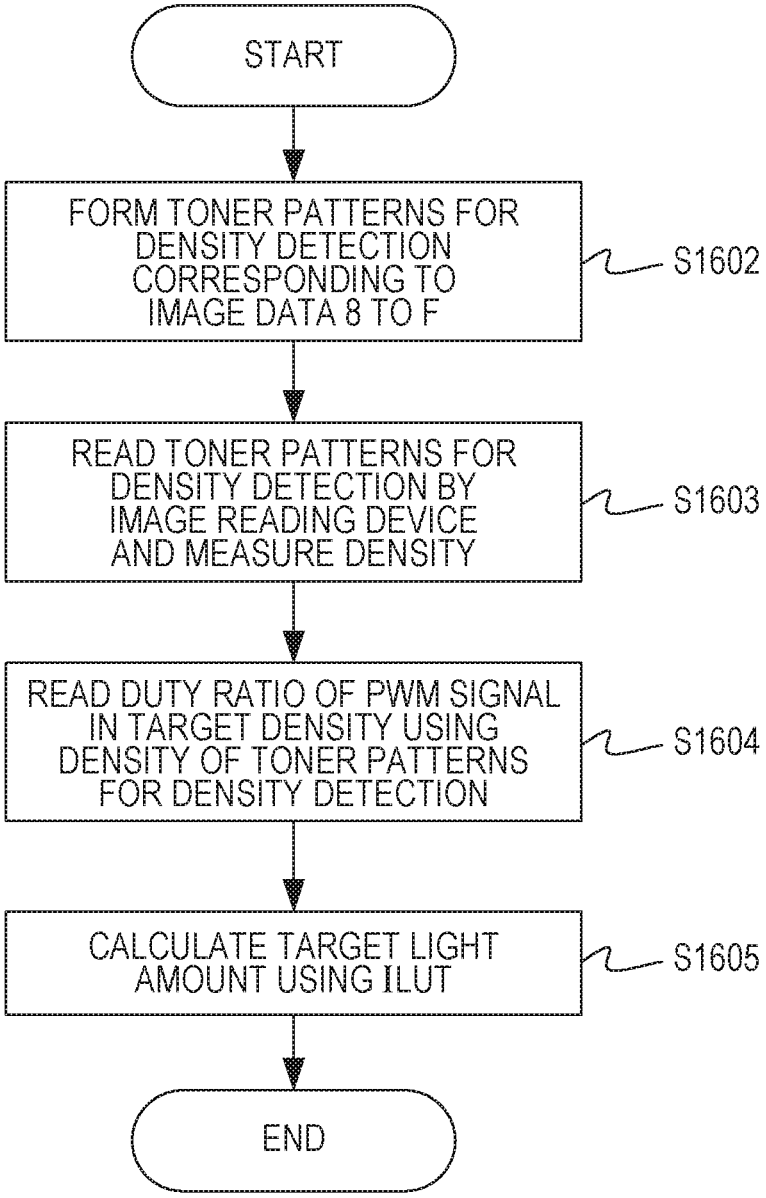
FIG. 12 is a flowchart of density correction control according to the second embodiment.
Figures 13A, 13B, 13C:
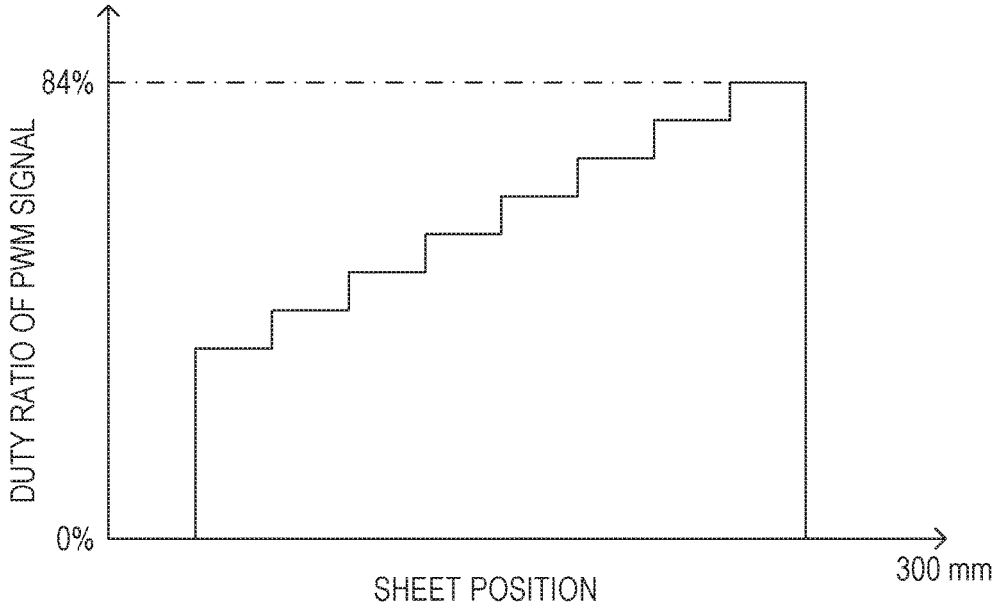
FIGS. 13A to 13E are graphs of the relationship between toner patterns for density detection and a duty ratio of the PWM signal, the toner patterns for density detection formed on a sheet, image data (gradation), the toner patterns for density detection, and the relationship between the density of the toner patterns for density detection and a duty ratio of the PWM signal, respectively.
Figure 13D:
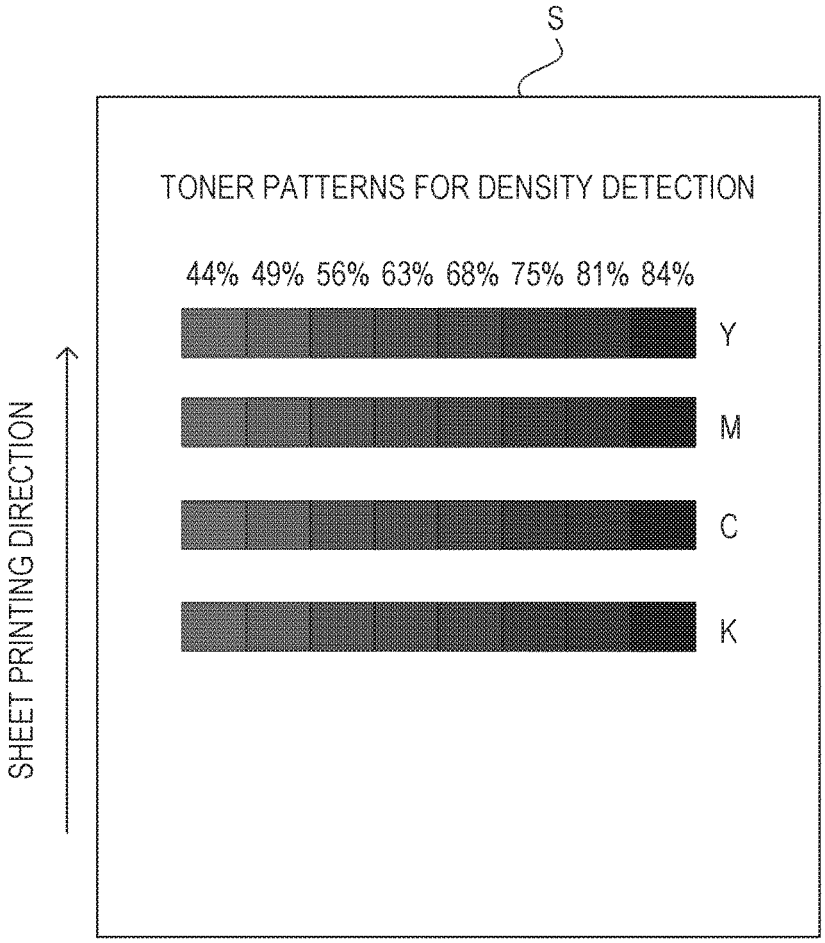

FIG. 12 is a flowchart of control in the image density correction mode. When the image density correction mode is started, the CPU 303 starts a process from S1602. FIG. 13A corresponds to FIG. 8A, and therefore, a description thereof is omitted. FIGS. 13B and 13C are diagrams illustrating gradation levels in Table 2 corresponding to various duty ratios of the PWM signal 323 of FIG. 13A. As illustrated in FIGS. 13A to 13C, in S1602, the CPU 303 individually forms toner patterns for density detection using density of image data 8 to F (gradation levels 8 to 15) for Y, M, C, and K. When the toner patterns having the gradation levels 8 to 15 are formed, the CPU 303 causes the conversion unit 325 to convert the gradation levels into the various duty ratios of the PWM signal 323 with reference to the ILUT of Table 2. Specifically, the CPU 303 causes the conversion unit 325 to convert the gradation levels 8 to 15 into duty ratios 44%, 49%, 56%, 63%, 68%, 75%, 81%, and 84%, respectively. Meanwhile, as with the first embodiment, it is assumed that a duty ratio of the light amount PWM signal 320 is 100%. The toner patterns for density detection printed on the sheet S are illustrated in FIG. 13D. Note that FIG. 13D corresponds to FIG. 8C, and therefore, a description thereof is omitted.

Figure 13E:
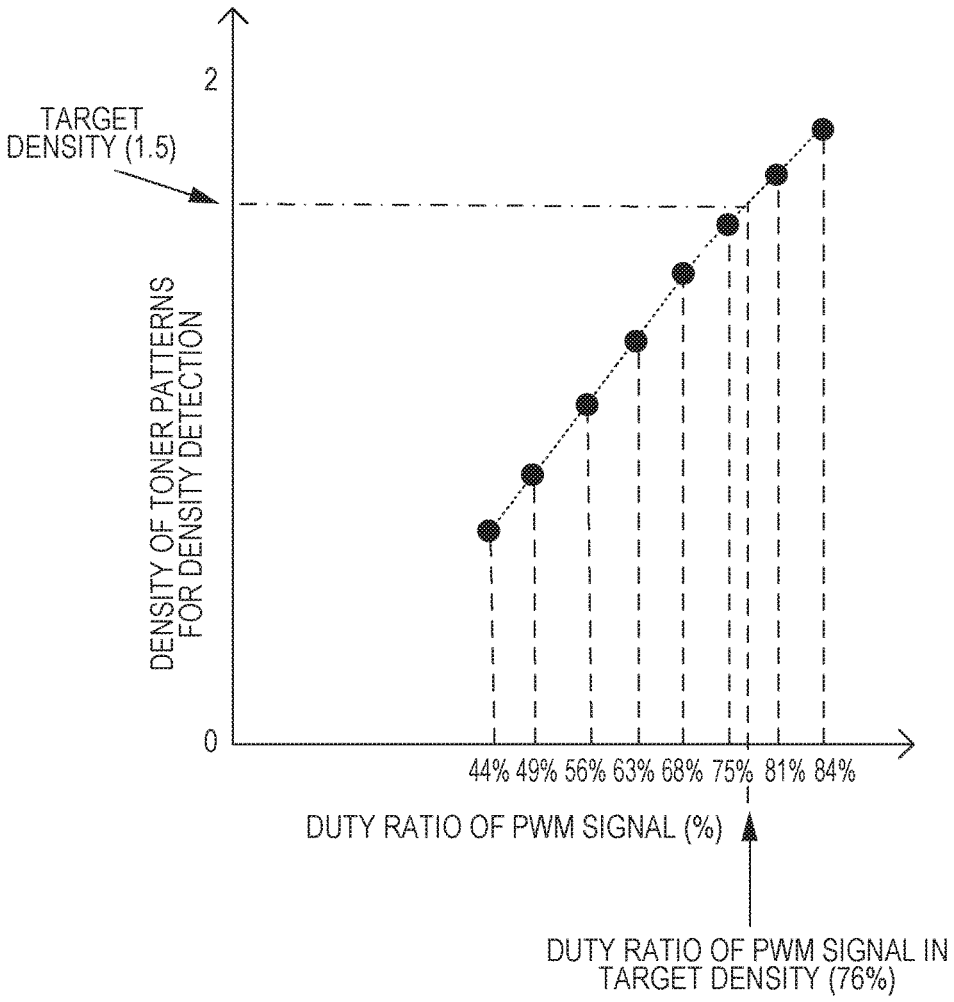

A process from S1603 to S1605 is the same as that from S603 to S605 in FIG. 7, and therefore, a description thereof is omitted. A result of density measurement performed in step 1603 is illustrated in FIG. 13E. FIG. 13E corresponds to FIG. 10B, and therefore, a description thereof is omitted. According to the result of the density measurement, a duty ratio of the PWM signal 323 corresponding to the target density of 1.5 is within a range from 75% to 81% as illustrated in FIG. 13E. Therefore, the CPU 303 performs linear interpolation so as to determine that the target density of 1.5 is obtained when the duty ratio of the PWM signal 323 is 76%.

When the CPU 303 determines that the duty ratio of the PWM signal 323 corresponding to the target density of 1.5 is 76%, the CPU 303 obtains, similarly to the first embodiment, a target light amount with reference to the relationship between the duty ratio of the PWM signal 323 and the integrated light amount of the laser light illustrated in FIG. 10A. The CPU 303 determines that the target light amount is 71% when the duty ratio of the PWM signal 323 is 76% according to the relationship illustrated in FIG. 10A. As with the first embodiment, the CPU 303 terminates the image density correction mode after storing the obtained target light amount in the RAM 3032. The CPU 303 performs printing with the target light amount stored in the RAM 3032.

In the first embodiment, the duty ratio of the PWM signal 323 for light amount control is controlled by the CPU 303. In this case, a setting of the duty ratio of the PWM signal 323 of the CPU 303 is different from that in printing. In this embodiment, a setting value of the duty ratio of the PWM signal 323 used in printing is used for formation of the toner patterns for density detection. Therefore, the CPU 303 is not required to perform a change of the setting of the duty ratio of the PWM signal 323, and accordingly, a period of time required for the setting may be reduced.

According to this embodiment, the toner patterns for density detection may be formed with high accuracy in the main scanning direction and an amount of laser light may be controlled with high accuracy.

Third Embodiment

Figure 14:
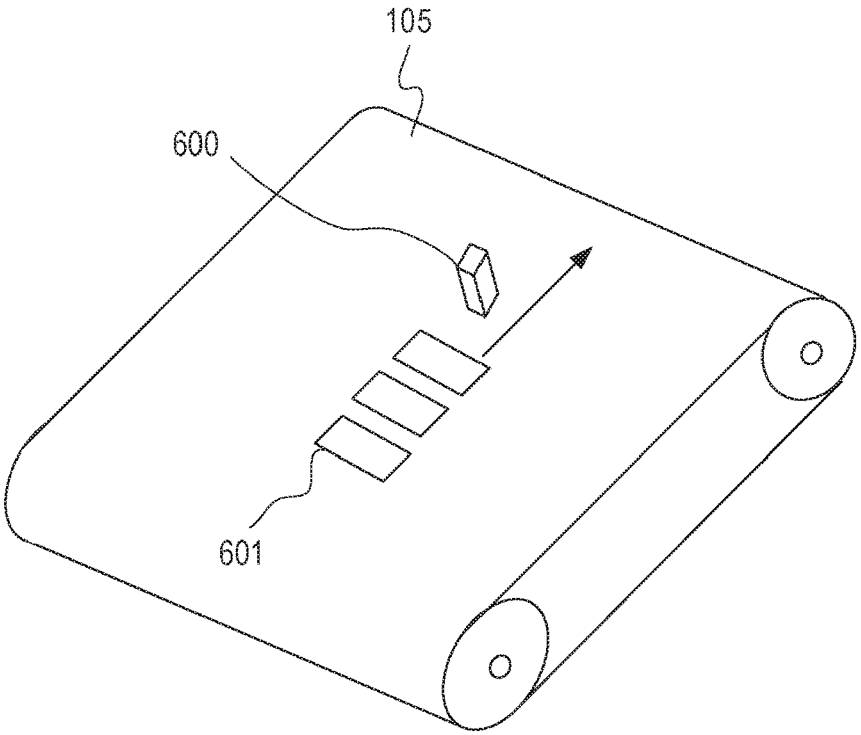
FIG. 14 is a diagram illustrating toner patterns for density detection formed on a belt according to a third embodiment.
Figure 15:
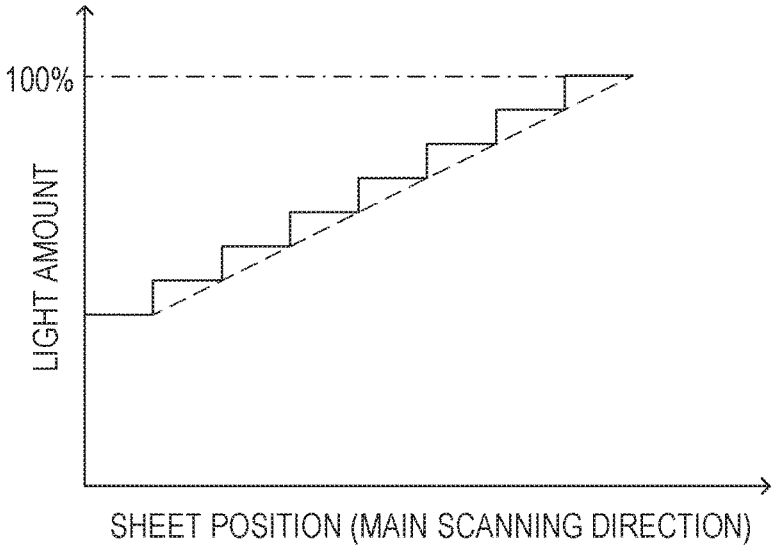
FIG. 15 is a graph of the relationship between a light amount and a sheet position obtained when a general filter is used.

In the first and second embodiments, the image reading device 115 is used in a method for reading density of toner patterns for density detection. However, a method for reading a toner pattern formed on the photoconductive drums 101 or a toner pattern formed on the belt 105 and measuring density may be employed, for example. For example, a toner pattern 601 for density detection is formed on the belt 105 as illustrated in FIG. 14 by changing a duty ratio of the PWM signal 323 using the method described in the first or second embodiment. Then the toner pattern 601 for density detection which is conveyed along with a movement of the belt 105 is measured by a density sensor 600. The CPU 303 calculates a duty ratio of the PWM signal 323 corresponding to a target density as described in the first and second embodiments based on a result of the measurement performed by the density sensor 600. The CPU 303 obtains a target light amount from the calculated PWM signal 323. Although only one density sensor 600 is illustrated in FIG. 14, a plurality of density patters may be simultaneously detected by a plurality of density sensors 600 arranged in the main scanning direction.

As described above, this embodiment is effective in a case where an image reading device serving as a single function machine is not used. Note that, when toner images on the photoconductive drums 101 are to be read by a sensor serving as a reading unit, not illustrated, toner patterns for density detection developed by toner are formed on the photoconductive drums 101 serving as a transfer member. In this case, a unit for forming the toner patterns for density detection includes, in addition to the optical scanning apparatus 200 and the photoconductive drums 101, the developer device 103. Furthermore, when a toner image on the belt 105 is to be read by the density sensor 600 serving as a reading unit, toner patterns for density detection are formed on the belt 105 serving as the transfer member as described above. In this case, a unit for forming the toner patterns for density detection includes, in addition to the optical scanning apparatus 200 and the photoconductive drums 101, the developer device 103 and the transfer roller 104. Furthermore, an electrostatic latent image on the photoconductive drums 101 may be read by the sensor serving as the reading unit, not illustrated. In this case, a plurality of latent image patterns having different density levels are formed on the photoconductive drums 101. Furthermore, in this case, a unit for forming the latent image patterns having the different density levels includes the optical scanning apparatus 200 and the photoconductive drums 101.

According to this embodiment, the toner patterns for density detection may be formed with high accuracy in the main scanning direction and an amount of laser light may be controlled with high accuracy.

According to the present disclosure, patterns for density detection may be formed with high accuracy in a main scanning direction and an amount of laser light may be controlled with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-185367 filed Sep. 23, 2016, which is hereby incorporated by reference herein in its entirety.

What is claimed is:

1. An image forming apparatus comprising:

an image forming unit including a photoconductor, a light source configured to emit light beam in a light amount corresponding to a value of supplied current, a driving unit configured to supply current to the light source in accordance with a first pulse-with-modulation (PWM) signal generated based on image data, which includes a smoothing circuit which outputs a signal obtained by smoothing a second PWM signal input to control a value of the current supplied to the light source, and configured to control the value of the current in accordance with an output of the smoothing circuit, and a deflection unit configured to deflect the light beam emitted from the light source such that the light beam scan the photoconductor, wherein the image forming unit develops, using toner, electrostatic latent image formed on the photoconductor by being scanned by the light beam, transfers developed toner image on a recording sheet, and fixes the transferred toner image on the recording sheet; and a control unit configured to control the driving unit by changing a pulse width of the first PWM signal so that toner images for density detection having different density levels are formed in parallel in a scanning direction of the light beam, configured to set a target light amount of the light beam based on density information of the toner images for density detection, and configured to control a pulse width of the second PWM signal to be input to the smoothing circuit such that an amount of the light beam emitted from the light source based on the target light amount is controlled in accordance with a scanning position.

2. The image forming apparatus according to claim 1, comprising:

a storage unit configured to store relational data indicating a condition in which density of toner images formed when the image forming unit fixes an amount of the light beam and changes a pulse width of the first PWM signal and density of toner images formed when the image forming unit fixes the pulse width of the first PWM signal and changes an amount of the light beam become equal to each other, wherein the control unit sets a target light amount of the light beam based on density information of the toner images for density detection and the relational data.

3. The image forming apparatus according to claim 1, comprising:

a fixing unit configured to fix toner image developed on the photoconductor on a recording member; and a reading device configured to read a document image, wherein the control unit corrects density of an image formed based on input image data in accordance with density of the toner images for density detection formed on the recording member by the reading device.

4. The image forming apparatus according to claim 1, comprising:

a storage unit configured to store correction data used to control pulse widths of the second PWM signal corresponding to exposure positions of the light beam in a scanning direction of the light beam, wherein the control unit controls the pulse widths of the second PWM signal in one scanning period of the light beam in accordance with the correction data corresponding to the exposure positions of the light beam when toner image are formed on the photoconductor.

5. The image forming apparatus according to claim 4, wherein, when toner images for density detection having different density levels are formed in parallel in a scanning direction of the light beam, a pulse width of the second PWM signal in one scanning period of the light beam is controlled based on the correction data corresponding to the exposure positions of the light beam.

6. An image forming apparatus comprising:

an image forming unit including a photoconductor, a light source configured to emit light beam, a deflection unit configured to deflect the light beam such that the light beam emitted from the light source scan the photoconductor, a developing unit configured to develop electrostatic latent image, using toner, formed on the photoconductor by performing scanning using the light beam deflected by the deflection unit, and a transfer unit configured to transfer toner image developed by the developing unit on transfer member;

a setting unit configured to cause the image forming unit to set a target light amount of the light beam based on input density information such that toner images for density detection having different density levels are formed on the transfer member, the density information of the toner images for density detection is input, and toner images of a target density are formed; and a storage unit configured to store relational data indicating a condition in which density of toner images formed when the image forming unit fixes an amount of the light beam and changes a period of time in which the light beam are emitted per unit time and density of toner images formed when the image forming unit fixes the period of time in which the light beam are emitted per unit time and changes an amount of the light beam become equal to each other, wherein the setting unit controls the image forming unit such that the toner images for density detection are formed in parallel in the scanning direction of the light beam under an image forming condition in which the period of time in which the light beam are emitted per unit time is changed, and sets a target light amount of the light beam based on density information of the toner images for density detection formed on the image forming unit and the relational data stored in the storage unit.

7. The image forming apparatus according to claim 6, comprising:

a fixing unit configured to fix toner image developed on the photoconductor on a recording member; and a reading device configured to read a document image, wherein the setting unit corrects density of an image formed based on input image data in accordance with density of the toner images for density detection formed on the recording member by the reading device.

8. The image forming apparatus according to claim 6, wherein the period of time in which the light beam are emitted per unit time is different from a period of time in which the light beam are emitted per unit time obtained when an image is formed.

9. The image forming apparatus according to claim 6, wherein the period of time in which the light beam are emitted per unit time corresponds to a period of time in which the light beam are emitted per unit time when an image is formed.

10. The image forming apparatus according to claim 9, wherein the period of time in which the light beam are emitted per unit time corresponds to gradation used when an image is formed.

11. The image forming apparatus according to claim 10, wherein the setting unit forms the toner images for density detection such that a value of the period of time in which the light beam are emitted per unit time is within a range from 10% inclusive to 90% inclusive.

* * * * *